US011043226B2

(12) United States Patent
Ravelli et al.

(10) Patent No.: US 11,043,226 B2
(45) Date of Patent: Jun. 22, 2021

(54) APPARATUS AND METHOD FOR ENCODING AND DECODING AN AUDIO SIGNAL USING DOWNSAMPLING OR INTERPOLATION OF SCALE PARAMETERS

(71) Applicant: Fraunhofer-Gesellschaft zur Förderung der angewandten Forschung e.V., Munich (DE)

(72) Inventors: Emmanuel Ravelli, Erlangen (DE); Markus Schnell, Erlangen (DE); Conrad Benndorf, Erlangen (DE); Manfred Lutzky, Erlangen (DE); Martin Dietz, Erlangen (DE); Srikanth Korse, Erlangen (DE)

(73) Assignee: Fraunhofer-Gesellschaft zur Forderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/859,106

(22) Filed: Apr. 27, 2020

(65) Prior Publication Data

US 2020/0294518 A1 Sep. 17, 2020

Related U.S. Application Data

(63) Continuation of application No. PCT/EP2018/080137, filed on Nov. 5, 2018, which is (Continued)

(51) Int. Cl.
*G10L 19/032* (2013.01)
*G10L 19/038* (2013.01)
*G10L 19/06* (2013.01)

(52) U.S. Cl.
CPC ..... *G10L 19/038* (2013.01); *G10L 19/032* (2013.01); *G10L 19/06* (2013.01)

(58) Field of Classification Search
CPC ..... G10L 19/06; G10L 19/032
See application file for complete search history.

(56) References Cited

U.S. PATENT DOCUMENTS 4,972,484 A 11/1990 Link et al.
5,012,517 A 4/1991 Chhatwal et al.
(Continued)

FOREIGN PATENT DOCUMENTS

CN 102779526 A 11/2012
CN 107103908 A 8/2017
(Continued)

OTHER PUBLICATIONS

P.A. Volkov, "Office Action for RU Application No. 2020120251", dated Oct. 28, 2020, Rospatent, Russia.
(Continued)

*Primary Examiner* — Feng-Tzer Tzeng
(74) *Attorney, Agent, or Firm* — Novick, Kim & Lee, PLLC; Jae Youn Kim; Jihun Kim

(57) ABSTRACT

An apparatus for encoding an audio signal includes: a converter for converting the audio signal into a spectral representation; a scale parameter calculator for calculating a first set of scale parameters from the spectral representation: a downsampler for downsampling the first set of scale parameters to obtain a second set of scale parameters, a second number of scale parameters in the second set of scale parameters being lower than a first number of scale parameters in the first set of scale parameters; a scale parameter encoder for generating an encoded representation of the second set of scale parameters; a spectral processor for processing the spectral representation using a third set of scale parameters, the third set of scale parameters having a third number of scale parameters being greater than the second number of scale parameters, the spectral processor being configured to use the first set of scale parameters or to
(Continued)

derive the third set of scale parameters from the second set of scale parameters or from the encoded representation of the second set of scale parameters using an interpolation operation; and an output interface for generating an encoded output signal comprising information on the encoded representation of the spectral representation and information on the encoded representation of the second set of scale parameters.

42 Claims, 11 Drawing Sheets

Related U.S. Application Data a continuation of application No. PCT/EP2017/078921, filed on Nov. 10, 2017.

(56) References Cited

U.S. PATENT DOCUMENTS 5,581,653 A * 12/1996 Todd ..... G10L 19/035 704/206
5,651,091 A 7/1997 Chen et al.
5,781,888 A 7/1998 Herre
5,812,971 A 9/1998 Herre
5,819,209 A 10/1998 Inoue
5,999,899 A 12/1999 Robinson
6,018,706 A 1/2000 Huang et al.
6,148,288 A 11/2000 Park
6,507,814 B1 1/2003 Gao
6,735,561 B1 5/2004 Johnston et al.
7,009,533 B1 3/2006 Wegener
7,353,168 B2 4/2008 Chen et al.
7,395,209 B1 7/2008 Dokic et al.
7,539,612 B2 * 5/2009 Thumpudi ..... G10L 19/035 704/200.1
7,546,240 B2 6/2009 Chen et al.
8,095,359 B2 1/2012 Boehm et al.
8,280,538 B2 10/2012 Kim et al.
8,612,240 B2 12/2013 Fuchs et al.
8,682,681 B2 3/2014 Fuchs et al.
8,738,385 B2 5/2014 Chen
8,751,246 B2 6/2014 Bayer et al.
8,847,795 B2 9/2014 Faure et al.
8,891,775 B2 11/2014 Mundt et al.
8,898,068 B2 11/2014 Fuchs et al.
9,489,961 B2 11/2016 Kovesi et al.
9,595,262 B2 3/2017 Fuchs et al.
10,726,854 B2 * 7/2020 Ghido ..... G10L 19/032
2005/0015249 A1 1/2005 Chen et al.
2007/0033056 A1 2/2007 Groeschl et al.
2007/0118369 A1 5/2007 Chen
2007/0127729 A1 6/2007 Breebaart et al.
2007/0129940 A1 6/2007 Geyersberger et al.
2007/0276656 A1 11/2007 Solbach et al.
2008/0033718 A1 2/2008 Chen et al.
2008/0126086 A1 5/2008 Kandhadai et al.
2009/0076830 A1 3/2009 Taleb
2009/0138267 A1 5/2009 Davidson et al.
2010/0010810 A1 1/2010 Morii
2010/0070270 A1 3/2010 Gao
2010/0115370 A1 5/2010 Ramo et al.
2010/0312552 A1 12/2010 Kandhadai et al.
2010/0312553 A1 12/2010 Fang et al.
2010/0324912 A1 12/2010 Oh et al.
2011/0015768 A1 1/2011 Kim et al.
2011/0022924 A1 1/2011 Malenovsky et al.
2011/0035212 A1 * 2/2011 Briand ..... G10L 19/0204 704/203
2011/0060597 A1 3/2011 Chen et al.
2011/0071839 A1 3/2011 Budnikov et al.
2011/0095920 A1 4/2011 Ashley et al.
2011/0096830 A1 4/2011 Ashley et al.
2011/0116542 A1 5/2011 Antonini et al.
2011/0196673 A1 8/2011 Park et al.
2011/0200198 A1 8/2011 Bayer et al.
2011/0238425 A1 9/2011 Lecomte et al.
2011/0238426 A1 9/2011 Borsum et al.
2012/0010879 A1 1/2012 Kikuiri et al.
2012/0022881 A1 1/2012 Geiger et al.
2012/0214544 A1 8/2012 Rodriguez et al.
2012/0265540 A1 10/2012 Fuchs et al.
2013/0030819 A1 1/2013 Carlsson et al.
2013/0226594 A1 8/2013 Fuchs et al.
2013/0282369 A1 10/2013 Ryu et al.
2014/0052439 A1 2/2014 Nanjundaswamy et al.
2014/0067404 A1 3/2014 Baumgarte
2014/0108020 A1 4/2014 Bai et al.
2014/0142957 A1 5/2014 Lee et al.
2015/0010155 A1 1/2015 Lang et al.
2015/0081312 A1 3/2015 Fuchs et al.
2015/0142452 A1 5/2015 Lee et al.
2015/0154969 A1 6/2015 Craven et al.
2015/0170668 A1 6/2015 Kovesi et al.
2015/0221311 A1 8/2015 Jeon et al.
2015/0302859 A1 10/2015 Aguilar et al.
2015/0325246 A1 11/2015 Chen et al.
2016/0027450 A1 1/2016 Gao
2016/0189721 A1 6/2016 Johnston et al.
2016/0225384 A1 8/2016 Kjörling et al.
2016/0293175 A1 10/2016 Atti et al.
2016/0365097 A1 12/2016 Guan et al.
2016/0372125 A1 12/2016 Atti et al.
2016/0372126 A1 12/2016 Atti et al.
2016/0379655 A1 12/2016 Truman et al.
2017/0011747 A1 1/2017 Faure et al.
2017/0053658 A1 2/2017 Atti et al.
2017/0103769 A1 4/2017 Laaksonen et al.
2017/0110135 A1 4/2017 Disch et al.
2017/0133029 A1 5/2017 Doehla et al.
2017/0140769 A1 5/2017 Dietz et al.
2017/0154631 A1 6/2017 Bayer et al.
2017/0154635 A1 6/2017 Doehla et al.
2017/0221495 A1 8/2017 Oh et al.
2017/0236521 A1 8/2017 Atti et al.
2017/0294196 A1 10/2017 Bradley et al.

FOREIGN PATENT DOCUMENTS

EP 0716787 A1 * 6/1996 ..... H04B 1/667
EP 0732687 B2 9/1996
EP 1791115 A2 5/2007
EP 2676266 B1 12/2013
EP 2980796 A1 2/2016
EP 2980799 A1 2/2016
EP 3111624 A1 1/2017
FR 2944664 A1 10/2010
KR 100261253 B1 7/2000
KR 20030031936 A 4/2003
KR 20170000933 A 1/2017
RU 2337414 C2 10/2008
RU 2376657 C2 12/2009
RU 2413312 C2 2/2011
RU 2439718 C1 1/2012
RU 2483365 C2 5/2013
RU 2520402 C2 6/2014
RU 256381 C2 11/2015
RU 2596594 C2 9/2016
RU 2596596 C2 9/2016
RU 2628162 C2 8/2017
TW 200809770 A 2/2008
TW 201005730 A 2/2010
TW 201126510 A 8/2011
TW 201131550 A 9/2011
TW 201207839 A 2/2012
TW 201243832 A 11/2012
TW 201612896 A 4/2016
TW 201618080 A 5/2016
TW 201618086 A 5/2016
TW 201642246 A 12/2016
TW 201642247 A 12/2016
TW 201705126 A 2/2017
TW 201711021 A 3/2017

(56) References Cited

FOREIGN PATENT DOCUMENTS

| | | | |
|---|---|---|---|
| TW | 201713061 | A | 4/2017 |
| TW | 201724085 | A | 7/2017 |
| TW | 201732779 | A | 9/2017 |
| WO | 9916050 | A1 | 4/1999 |
| WO | 2004/072951 | A1 | 8/2004 |
| WO | 2005/086139 | A1 | 9/2005 |
| WO | 2007/073604 | A1 | 7/2007 |
| WO | 2007/138511 | A1 | 12/2007 |
| WO | 2008/046505 | A1 | 4/2008 |
| WO | 2011/048118 | A1 | 4/2011 |
| WO | 2011/086066 | A1 | 7/2011 |
| WO | 2011/086067 | A1 | 7/2011 |
| WO | 2012/000882 | A | 1/2012 |
| WO | 2012/000882 | A1 | 1/2012 |
| WO | 2012/126893 | A | 9/2012 |
| WO | 2014/165668 | A | 10/2014 |
| WO | 2014/202535 | A | 12/2014 |
| WO | 2014/202535 | A1 | 12/2014 |
| WO | 2015/063227 | A1 | 5/2015 |
| WO | 2015/071173 | A1 | 5/2015 |
| WO | 2015/174911 | A1 | 11/2015 |

OTHER PUBLICATIONS

P.A. Volkov, "Office Action for RU Application No. 2020120256", dated Oct. 28, 2020, Rospatent, Russia.

D.V.Travnikov, "Decision on Grant for RU Application No. 2020118969", dated Nov. 2, 2020, Rospatent, Russia.

Rospatent Examiner, "Decision on Grant Patent for Invention for RU Application No. 2020118949", Nov. 11, 2020, Rospatent, Russia.

ETSI TS 126 445 V13.2.0 (Aug. 2016), Universal Mobile Telecommunications System (UMTS); LTE; Codec for Enhanced Voice Services (EVS); Detailed algorithmic description (3GPP TS 26.445 version 13.2.0 Release 13) [Online]. Available: http://www.3gpp.org/ftp/Specs/archive/26_series/26.445/26445-d00.zip.

Geiger, "Audio Coding based on integer transform", Ilmenau: https://www.db-thueringen.de/receive/dbt_mods_00010054, 2004.

Henrique S Malvar, "Biorthogonal and Nonuniform Lapped Transforms for Transform Coding with Reduced Blocking and Ringing Artifacts", IEEE Transactions on Signal Processing, IEEE Service Center, New York, NY, US, (Apr. 1998), vol. 46, No. 4, ISSN 1053-587X, XP011058114.

Anonymous, "ISO/IEC 14496-3:2005/FDAM 9, AAC-ELD", 82. MPEG Meeting;Oct. 22, 2007-Oct. 26, 2007; Shenzhen; (Motion Picture Expert Group or ISO/IEC JTC1/SC29/WG11),, (Feb. 21, 2008), No. N9499, XP030015994.

Virette, "Low Delay Transform for High Quality Low Delay Audio Coding", Université de Rennes 1, (Dec. 10, 2012), pp. 1-195, URL: https://hal.inria.fr/tel-01205574/document, (Mar. 30, 2016), XP055261425.

ISO/IEC 14496-3:2001; Information technology—Coding of audio-visual objects—Part 3: Audio.

3GPP TS 26.403 v14.0.0 (Mar. 2017); General audio codec audio processing functions; Enhanced acPlus general audio codec; Encoder specification; Advanced Audio Coding (AAC) part; (Release 14).

ISO/IEC 23003-3; Information technology—MPEG audio technologies—Part 3: Unified speech and audio coding, 2011.

3GPP TS 26.445 V14.1.0 (Jun. 2017), 3rd Generation Partnership Project; Technical Specification Group Services and System Aspects; Codec for Enhanced Voice Services (EVS); Detailed Algorithmic Description (Release 14), http://www.3gpp.org/ftp//Specs/archive/26_series/26.445/26445-e10.zip, Section 5.1.6 "Bandwidth detection".

Eksler Vaclav et al, "Audio bandwidth detection in the EVS codec", 2015 IEEE Global Conference on Signal and Information Processing (GLOBALSIP), IEEE, (Dec. 14, 2015), doi:10.1109/GLOBALSIP.2015.7418243, pp. 488-492, XP032871707.

Oger M et al, "Transform Audio Coding with Arithmetic-Coded Scalar Quantization and Model-Based Bit Allocation", International Conference on Acoustics, Speech, and Signalprocessing, IEEE, XX, Apr. 15, 2007 (Apr. 15, 2007), p. IV-545, XP002464925.

Asad et al., "An enhanced least significant bit modification technique for audio steganography", International Conference on Computer Networks and Information Technology, Jul. 11-13, 2011.

Makandar et al, "Least Significant Bit Coding Analysis for Audio Steganography", Journal of Future Generation Computing, vol. 2, No. 3, Mar. 2018.

ISO/IEC 23008-3:2015; Information technology—High efficiency coding and media delivery in heterogeneous environments—Part 3: 3D audio.

ITU-T G.718 (Jun. 2008): Series G: Transmission Systems and Media, Digital Systems and Networks, Digital terminal equipments—Coding of voice and audio signals, Frame error robust narrow-band and wideband embedded variable bit-rate coding of speech and audio from 8-32 kbit/s.

3GPP TS 26.447 V14.1.0 (Jun. 2017), Technical Specification, 3rd Generation Partnership Project; Technical Specification Group Services and System Aspects; Codec for Enhanced Voice Services (EVS); Error Concealment of Lost Packets (Release 14).

DVB Organization, "ISO-IEC_23008-3_A3_(E)_(H 3DA FDAM3).docx", DVB, Digital Video Broadcasting, C/O EBU—17A Ancienne Route—CH-1218 Grand Saconnex, Geneva—Switzerland, (Jun. 13, 2016), XP017851888.

Hill et al., "Exponential stability of time-varying linear systems," IMA J Numer Anal, pp. 865-885, 2011.

3GPP TS 26.090 V14.0.0 (Mar. 2017), 3rd Generation Partnership Project; Technical Specification Group Services and System Aspects; Mandatory Speech Codec speech processing functions; Adaptive Multi-Rate (AMR) speech codec; Transcoding functions (Release 14).

3GPP TS 26.190 V14.0.0 (Mar. 2017), Technical Specification, 3rd Generation Partnership Project; Technical Specification Group Services and System Aspects; Speech codec speech processing functions; Adaptive Multi-Rate—Wideband (AMR-WB) speech codec; Transcoding functions (Release 14).

3GPP TS 26.290 V14.0.0 (Mar. 2017), Technical Specification, 3rd Generation Partnership Project; Technical Specification Group Services and System Aspects; Audio codec processing functions; Extended Adaptive Multi-Rate—Wideband (AMR-WB+) codec; Transcoding functions (Release 14).

Edler et al., "Perceptual Audio Coding Using a Time-Varying Linear Pre- and Post-Filter," in AES 109th Convention, Los Angeles, 2000.

Gray et al., "Digital lattice and ladder filter synthesis," IEEE Transactions on Audio and Electroacoustics, vol. vol. 21, No. No. 6, pp. 491-500, 1973.

Lamoureux et al., "Stability of time variant filters," Crewes Research Report—vol. 19, 2007.

Herre et al., "Enhancing the performance of perceptual audio coders by using temporal noise shaping (TNS)." Audio Engineering Society Convention 101. Audio Engineering Society, 1996.

Herre et al., "Continuously signal-adaptive filterbank for high-quality perceptual audio coding." Applications of Signal Processing to Audio and Acoustics, 1997. 1997 IEEE ASSP Workshop on. IEEE, 1997.

Herre, "Temporal noise shaping, quantization and coding methods in perceptual audio coding: A tutorial introduction." Audio Engineering Society Conference: 17th International Conference: High-Quality Audio Coding. Audio Engineering Society, 1999.

Fuchs Guillaume et al, "Low delay LPC and MDCT-based audio coding in the EVS codec", 2015 IEEE International Conference on Acoustics, Speech and Signal Processing (ICASSP), IEEE, (Apr. 19, 2015), doi:10.1109/ICASSP.2015.7179068, pp. 5723-5727, XP033187858.

Niamut et al, "RD Optimal Temporal Noise Shaping for Transform Audio Coding", Acoustics, Speech and Signal Processing, 2006. ICASSP 2006 Proceedings. 2006 IEEE International Conference on Toulouse, France May 14-19, 2006, Piscataway, NJ, USA,IEEE, Piscataway, NJ, USA, (Jan. 1, 2006), doi:10.1109/ICASSP.2006.1661244, ISBN 978-1-4244-0469-8, pp. V-V, XP031015996.

ITU-T G.711 (Sep. 1999): Series G: Transmission Systems and Media, Digital Systems and Networks, Digital transmission systems—Terminal equipments—Coding of analogue signals by pulse code

(56) References Cited

OTHER PUBLICATIONS modulation, Pulse code modulation (PCM) of voice frequencies, Appendix I: A high quality low-complexity algorithm for packet loss concealment with G.711.
Cheveigne et al.,"Yin, a fundamental frequency estimator for speech and music." The Journal of the Acoustical Society of America 111.4 (2002): 1917-1930.
Ojala P et al, "A novel pitch-lag search method using adaptive weighting and median filtering", Speech Coding Proceedings, 1999 IEEE Workshop on Porvoo, Finland Jun. 20-23, 1999, Piscataway, NJ, USA, IEEE, US, (Jun. 20, 1999), doi:10.1109/SCFT.1999.781502, ISBN 978-0-7803-5651-1, pp. 114-116, XP010345546.
"5 Functional description of the encoder", Dec. 10, 2014 (Dec. 10, 2014), 3GPP Standard; 26445-C10_1_SO5_S0501, 3RD Generation Partnership Project (3GPP)?, Mobile Competence Centre ; 650, Route Des Lucioles ; F-06921 Sophia-Antipolis Cedex ; France Retrieved from the Internet:URL: http://www.3gpp.org/ftp/Specs/2014-12/Rel-12/26_series/ XP050907035.
Santosh Mehtry, "Office Action for IN Application No. 202037019203", dated Mar. 19, 2021, Intellectual Property India, India.

* cited by examiner (SCALE FACTOR CALCULATOR)

(DOWNSAMPLER)

(SCALE FACTOR ENCODER)

(SPECTRAL PROCESSOR)

APPARATUS AND METHOD FOR ENCODING AND DECODING AN AUDIO SIGNAL USING DOWNSAMPLING OR INTERPOLATION OF SCALE PARAMETERS

CROSS-REFERENCES TO RELATED APPLICATIONS

This application is a continuation of copending International Application No. PCT/EP2018/080137, filed Nov. 5, 2018, which is incorporated herein by reference in its entirety, and additionally claims priority from International Application No. PCT/EP2017/078921, filed Nov. 10, 2017, which is incorporated herein by reference in its entirety.

BACKGROUND OF THE INVENTION

The present invention is related to audio processing and, particularly, to audio processing operating in a spectral domain using scale parameters for spectral bands.

Conventional Technology 1: Advanced Audio Coding (AAC)

In one of the most widely used state-of-the-art perceptual audio codec, Advanced Audio Coding (AAC) [1-2], spectral noise shaping is performed with the help of so-called scale factors.

In this approach, the MDCT spectrum is partitioned into a number of non-uniform scale factor bands. For example at 48 kHz, the MDCT has 1024 coefficients and it is partitioned into 49 scale factor bands. In each band, a scale factor is used to scale the MDCT coefficients of that band. A scalar quantizer with constant step size is then employed to quantize the scaled MDCT coefficients. At the decoder-side, inverse scaling is performed in each band, shaping the quantization noise introduced by the scalar quantizer.

The 49 scale factors are encoded into the bitstream as side-information. It usually involves a significantly high amount of bits for encoding the scale factors, due to the relatively high number of scale factors and the high precision involved. This can become a problem at low bitrate and/or at low delay.

Conventional Technology 2: MDCT-Based TCX

In MDCT-based TCX, a transform-based audio codec used in the MPEG-D USAC [3] and 3GPP EVS [4] standards, spectral noise shaping is performed with the help of a LPC-based perceptual filer, the same perceptual filter as used in recent ACELP-based speech codecs (e.g. AMR-WB).

In this approach, a set of 16 LPCs is first estimated on a pre-emphasized input signal. The LPCs are then weighted and quantized. The frequency response of the weighted and quantized LPCs is then computed in 64 uniformly spaced bands. The MDCT coefficients are then scaled in each band using the computed frequency response. The scaled MDCT coefficients are then quantized using a scalar quantizer with a step size controlled by a global gain. At the decoder, inverse scaling is performed in every 64 bands, shaping the quantization noise introduced by the scalar quantizer.

This approach has a clear advantage over the AAC approach: it involves the encoding of only 16 (LPC)+1 (global-gain) parameters as side-information (as opposed to the 49 parameters in AAC). Moreover, 16 LPCs can be efficiently encoded with a small number of bits by employing a LSF representation and a vector quantizer. Consequently, the approach of conventional technology 2 involves less side-information bits as the approach of conventional technology 1, which can makes a significant difference at low bitrate and/or low delay.

However, this approach has also some drawbacks. The first drawback is that the frequency scale of the noise shaping is restricted to be linear (i.e. using uniformly spaced bands) because the LPCs are estimated in the time-domain. This is disadvantageous because the human ear is more sensible in low frequencies than in the high frequencies. The second drawback is the high complexity of this approach. The LPC estimation (autocorrelation, Levinson-Durbin), LPC quantization (LPC<->LSF conversion, vector quantization) and LPC frequency response computation are all costly operations. The third drawback is that this approach is not very flexible because the LPC-based perceptual filter cannot be easily modified and this prevents some specific tunings that would be involved in critical audio items.

Conventional Technology 3: Improved MDCT-Based TCX

Some recent work has addressed the first drawback and partly the second drawback of conventional technology 2. It was published in U.S. Pat. No. 9,595,262 B2, EP2676266 B1. In this new approach, the autocorrelation (for estimating the LPCs) is no more performed in the time-domain but it is instead computed in the MDCT domain using an inverse transform of the MDCT coefficient energies. This allows using a non-uniform frequency scale by simply grouping the MDCT coefficients into 64 non-uniform bands and computing the energy of each band. It also reduces the complexity involved to compute the autocorrelation.

However, most of the second drawback and the third drawback remain, even with the new approach.

SUMMARY

According to an embodiment, an apparatus for encoding an audio signal may have: a converter for converting the audio signal into a spectral representation; a scale parameter calculator for calculating a first set of scale parameters from the spectral representation: a downsampler for downsampling the first set of scale parameters to obtain a second set of scale parameters, wherein a second number of scale parameters in the second set of scale parameters is lower than a first number of scale parameters in the first set of scale parameters; a scale parameter encoder for generating an encoded representation of the second set of scale parameters; a spectral processor for processing the spectral representation using a third set of scale parameters, the third set of scale parameters having a third number of scale parameters being greater than the second number of scale parameters, wherein the spectral processor is configured to use the first set of scale parameters or to derive the third set of scale parameters from the second set of scale parameters or from the encoded representation of the second set of scale parameters using an interpolation operation; and an output interface for generating an encoded output signal including information on the encoded representation of the spectral representation and information on the encoded representation of the second set of scale parameters.

According to another embodiment, a method for encoding an audio signal may have the steps of: converting the audio signal into a spectral representation; calculating a first set of scale parameters from the spectral representation: downsampling the first set of scale parameters to obtain a second set of scale parameters, wherein a second number of scale parameters in the second set of scale parameters is lower than a first number of scale parameters in the first set of scale parameters; generating an encoded representation of the second set of scale parameters; processing the spectral representation using a third set of scale parameters, the third set of scale parameters having a third number of scale parameters being greater than the second number of scale parameters, wherein the processing uses the first set of scale parameters or derives the third set of scale parameters from the second set of scale parameters or from the encoded representation of the second set of scale parameters using an interpolation operation; and generating an encoded output signal including information on the encoded representation of the spectral representation and information on the encoded representation of the second set of scale parameters.

According to another embodiment, an apparatus for decoding an encoded audio signal including information on an encoded spectral representation and information on an encoded representation of a second set of scale parameters may have: an input interface for receiving the encoded signal and extracting the encoded spectral representation and the encoded representation of the second set of scale parameters; a spectrum decoder for decoding the encoded spectral representation to obtain a decoded spectral representation; a scale parameter decoder for decoding the encoded second set of scale parameters to obtain a first set of scale parameters, wherein the number of scale parameters of the second set is smaller than a number of scale parameters of the first set; a spectral processor for processing the decoded spectral representation using the first set of scale parameters to obtain a scaled spectral representation; and a converter for converting the scaled spectral representation to obtain a decoded audio signal.

According to another embodiment, a method for decoding an encoded audio signal including information on an encoded spectral representation and information on an encoded representation of a second set of scale parameters may have the steps of: receiving the encoded signal and extracting the encoded spectral representation and the encoded representation of the second set of scale parameters; decoding the encoded spectral representation to obtain a decoded spectral representation; decoding the encoded second set of scale parameters to obtain a first set of scale parameters, wherein the number of scale parameters of the second set is smaller than a number of scale parameters of the first set; processing the decoded spectral representation using the first set of scale parameters to obtain a scaled spectral representation; and converting the scaled spectral representation to obtain a decoded audio signal.

According to another embodiment, a non-transitory digital storage medium including a computer program stored thereon to perform the method for encoding an audio signal, including: converting the audio signal into a spectral representation; calculating a first set of scale parameters from the spectral representation: downsampling the first set of scale parameters to obtain a second set of scale parameters, wherein a second number of scale parameters in the second set of scale parameters is lower than a first number of scale parameters in the first set of scale parameters; generating an encoded representation of the second set of scale parameters; processing the spectral representation using a third set of scale parameters, the third set of scale parameters including a third number of scale parameters being greater than the second number of scale parameters, wherein the processing uses the first set of scale parameters or derives the third set of scale parameters from the second set of scale parameters or from the encoded representation of the second set of scale parameters using an interpolation operation; and generating an encoded output signal including information on the encoded representation of the spectral representation and information on the encoded representation of the second set of scale parameters, when said computer program is run by a computer.

According to another embodiment, a non-transitory digital storage medium including a computer program stored thereon to perform the method for decoding an encoded audio signal including information on an encoded spectral representation and information on an encoded representation of a second set of scale parameters, including: receiving the encoded signal and extracting the encoded spectral representation and the encoded representation of the second set of scale parameters; decoding the encoded spectral representation to obtain a decoded spectral representation; decoding the encoded second set of scale parameters to obtain a first set of scale parameters, wherein the number of scale parameters of the second set is smaller than a number of scale parameters of the first set; processing the decoded spectral representation using the first set of scale parameters to obtain a scaled spectral representation; and converting the scaled spectral representation to obtain a decoded audio signal, when said computer program is run by a computer.

An apparatus for encoding an audio signal comprises a converter for converting the audio signal into a spectral representation. Furthermore, a scale parameter calculator for calculating a first set of scale parameters from the spectral representation is provided. Additionally, in order to keep the bitrate as low as possible, the first set of scale parameters is downsampled to obtain a second set of scale parameters, wherein a second number of scale parameters in the second set of scale parameters is lower than a first number of scale parameters in the first set of scale parameters. Furthermore, a scale parameter encoder for generating an encoded representation of the second set of scale parameters is provided in addition to a spectral processor for processing the spectral representation using a third set of scale parameters, the third set of scale parameters having a third number of scale parameters being greater than the second number of scale parameters. Particularly, the spectral processor is configured to use the first set of scale parameters or to derive the third set of scale parameters from the second set of scale parameters or from the encoded representation of the second set of scale parameters using an interpolation operation to obtain an encoded representation of the spectral representation. Furthermore, an output interface is provided for generating an encoded output signal comprising information on the encoded representation of the spectral representation and also comprising information on the encoded representation of the second set of scale parameters.

The present invention is based on the finding that a low bitrate without substantial loss of quality can be obtained by scaling, on the encoder-side, with a higher number of scale factors and by downsampling the scale parameters on the encoder-side into a second set of scale parameters or scale factors, where the scale parameters in the second set that is then encoded and transmitted or stored via an output interface is lower than the first number of scale parameters. Thus, a fine scaling on the one hand and a low bitrate on the other hand is obtained on the encoder-side.

On the decoder-side, the transmitted small number of scale factors is decoded by a scale factor decoder to obtain a first set of scale factors where the number of scale factors or scale parameters in the first set is greater than the number of scale factors or scale parameters of the second set and, then, once again, a fine scaling using the higher number of scale parameters is performed on the decoder-side within a spectral processor to obtain a fine-scaled spectral representation.

Thus, a low bitrate on the one hand and, nevertheless, a high quality spectral processing of the audio signal spectrum on the other hand are obtained.

Spectral noise shaping as done in advantageous embodiments is implemented using only a very low bitrate. Thus, this spectral noise shaping can be an essential tool even in a low bitrate transform-based audio codec. The spectral noise shaping shapes the quantization noise in the frequency domain such that the quantization noise is minimally perceived by the human ear and, therefore, the perceptual quality of the decoded output signal can be maximized.

Advantageous embodiments rely on spectral parameters calculated from amplitude-related measures, such as energies of a spectral representation. Particularly, band-wise energies or, generally, band-wise amplitude-related measures are calculated as the basis for the scale parameters, where the bandwidths used in calculating the band-wise amplitude-related measures increase from lower to higher bands in order to approach the characteristic of the human hearing as far as possible. Advantageously, the division of the spectral representation into bands is done in accordance with the well-known Bark scale.

In further embodiments, linear-domain scale parameters are calculated and are particularly calculated for the first set of scale parameters with the high number of scale parameters, and this high number of scale parameters is converted into a log-like domain. A log-like domain is generally a domain, in which small values are expanded and high values are compressed. Then, the downsampling or decimation operation of the scale parameters is done in the log-like domain that can be a logarithmic domain with the base 10, or a logarithmic domain with the base 2, where the latter may be advantageous for implementation purposes. The second set of scale factors is then calculated in the log-like domain and, advantageously, a vector quantization of the second set of scale factors is performed, wherein the scale factors are in the log-like domain. Thus, the result of the vector quantization indicates log-like domain scale parameters. The second set of scale factors or scale parameters has, for example, a number of scale factors half of the number of scale factors of the first set, or even one third or yet even more advantageously, one fourth Then, the quantized small number of scale parameters in the second set of scale parameters is brought into the bitstream and is then transmitted from the encoder-side to the decoder-side or stored as an encoded audio signal together with a quantized spectrum that has also been processed using these parameters, where this processing additionally involves quantization using a global gain. Advantageously, however, the encoder derives from these quantized log-like domain second scale factors once again a set of linear domain scale factors, which is the third set of scale factors, and the number of scale factors in the third set of scale factors is greater than the second number and is advantageously even equal to the first number of scale factors in the first set of first scale factors. Then, on the encoder-side, these interpolated scale factors are used for processing the spectral representation, where the processed spectral representation is finally quantized and, in any way entropy-encoded, such as by Huffman-encoding, arithmetic encoding or vector-quantization-based encoding, etc.

In the decoder that receives an encoded signal having a low number of spectral parameters together with the encoded representation of the spectral representation, the low number of scale parameters is interpolated to a high number of scale parameters, i.e., to obtain a first set of scale parameters where a number of scale parameters of the scale factors of the second set of scale factors or scale parameters is smaller than the number of scale parameters of the first set, i.e., the set as calculated by the scale factor/parameter decoder. Then, a spectral processor located within the apparatus for decoding an encoded audio signal processes the decoded spectral representation using this first set of scale parameters to obtain a scaled spectral representation. A converter for converting the scaled spectral representation then operates to finally obtain a decoded audio signal that is advantageously in the time domain.

Further embodiments result in additional advantages set forth below. In advantageous embodiments, spectral noise shaping is performed with the help of 16 scaling parameters similar to the scale factors used in conventional technology 1. These parameters are obtained in the encoder by first computing the energy of the MDCT spectrum in 64 non-uniform bands (similar to the 64 non-uniform bands of conventional technology 3), then by applying some processing to the 64 energies (smoothing, pre-emphasis, noise-floor, log-conversion), then by downsampling the 64 processed energies by a factor of 4 to obtain 16 parameters which are finally normalized and scaled. These 16 parameters are then quantized using vector quantization (using similar vector quantization as used in conventional technology 2/3). The quantized parameters are then interpolated to obtain 64 interpolated scaling parameters. These 64 scaling parameters are then used to directly shape the MDCT spectrum in the 64 non-uniform bands. Similar to conventional technology 2 and 3, the scaled MDCT coefficients are then quantized using a scalar quantizer with a step size controlled by a global gain. At the decoder, inverse scaling is performed in every 64 bands, shaping the quantization noise introduced by the scalar quantizer.

As in conventional technology 2/3, the advantageous embodiment uses only 16+1 parameters as side-information and the parameters can be efficiently encoded with a low number of bits using vector quantization. Consequently, the advantageous embodiment has the same advantage as prior 2/3: it involves less side-information bits as the approach of conventional technology 1, which can makes a significant difference at low bitrate and/or low delay.

As in conventional technology 3, the advantageous embodiment uses a non-linear frequency scaling and thus does not have the first drawback of conventional technology 2.

Contrary to conventional technology 2/3, the advantageous embodiment does not use any of the LPC-related functions which have high complexity. The processing functions involved (smoothing, pre-emphasis, noise-floor, log-conversion, normalization, scaling, interpolation) need very small complexity in comparison. Only the vector quantization still has relatively high complexity. But some low complexity vector quantization techniques can be used with small loss in performance (multi-split/multi-stage approaches). The advantageous embodiment thus does not have the second drawback of conventional technology 2/3 regarding complexity.

Contrary to conventional technology 2/3, the advantageous embodiment is not relying on a LPC-based perceptual filter. It uses 16 scaling parameters which can be computed with a lot of freedom. The advantageous embodiment is more flexible than the conventional technology 2/3 and thus does not have the third drawback of conventional technology 2/3.

In conclusion, the advantageous embodiment has all advantages of conventional technology 2/3 with none of the drawbacks.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
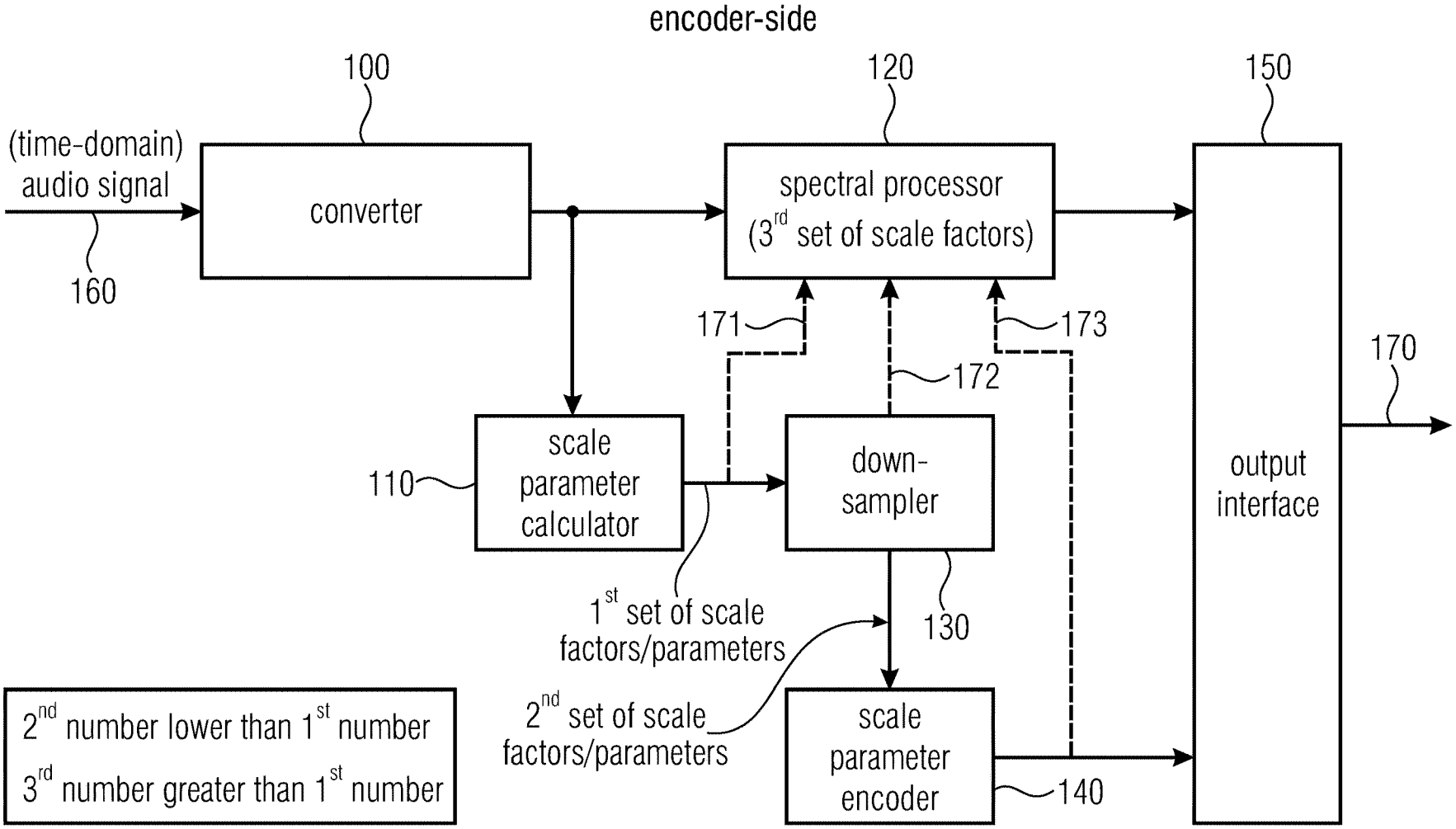
FIG. 1 is a block diagram of an apparatus for encoding an audio signal.

FIG. 1 illustrates an apparatus for encoding an audio signal 160. The audio signal 160 advantageously is available in the time-domain, although other representations of the audio signal such as a prediction-domain or any other domain would principally also be useful. The apparatus comprises a converter 100, a scale factor calculator 110, a spectral processor 120, a downsampler 130, a scale factor encoder 140 and an output interface 150. The converter 100 is configured for converting the audio signal 160 into a spectral representation. The scale factor calculator 110 is configured for calculating a first set of scale parameters or scale factors from the spectral representation.

Throughout the specification, the term "scale factor" or "scale parameter" is used in order to refer to the same parameter or value, i.e., a value or parameter that is, subsequent to some processing, used for weighting some kind of spectral values. This weighting, when performed in the linear domain is actually a multiplying operation with a scaling factor. However, when the weighting is performed in a logarithmic domain, then the weighting operation with a scale factor is done by an actual addition or subtraction operation. Thus, in the terms of the present application, scaling does not only mean multiplying or dividing but also means, depending on the certain domain, addition or subtraction or, generally means each operation, by which the spectral value, for example, is weighted or modified using the scale factor or scale parameter.

The downsampler 130 is configured for downsampling the first set of scale parameters to obtain a second set of scale parameters, wherein a second number of the scale parameters in the second set of scale parameters is lower than a first number of scale parameters in the first set of scale parameters. This is also outlined in the box in FIG. 1 stating that the second number is lower than the first number. As illustrated in FIG. 1, the scale factor encoder is configured for generating an encoded representation of the second set of scale factors, and this encoded representation is forwarded to the output interface 150. Due to the fact that the second set of scale factors has a lower number of scale factors than the first set of scale factors, the bitrate for transmitting or storing the encoded representation of the second set of scale factors is lower compared to a situation, in which the downsampling of the scale factors performed in the downsampler 130 would not have been performed.

Furthermore, the spectral processor 120 is configured for processing the spectral representation output by the converter 100 in FIG. 1 using a third set of scale parameters, the third set of scale parameters or scale factors having a third number of scale factors being greater than the second number of scale factors, wherein the spectral processor 120 is configured to use, for the purpose of spectral processing the first set of scale factors as already available from block 110 via line 171. Alternatively, the spectral processor 120 is configured to use the second set of scale factors as output by the downsampler 130 for the calculation of the third set of scale factors as illustrated by line 172. In a further implementation, the spectral processor 120 uses the encoded representation output by the scale factor/parameter encoder 140 for the purpose of calculating the third set of scale factors as illustrated by line 173 in FIG. 1. Advantageously, the spectral processor 120 does not use the first set of scale factors, but uses either the second set of scale factors as calculated by the downsampler or even more advantageously uses the encoded representation or, generally, the quantized second set of scale factors and, then, performs an interpolation operation to interpolate the quantized second set of spectral parameters to obtain the third set of scale parameters that has a higher number of scale parameters due to the interpolation operation.

Thus, the encoded representation of the second set of scale factors that is output by block 140 either comprises a codebook index for a advantageously used scale parameter codebook or a set of corresponding codebook indices. In other embodiments, the encoded representation comprises the quantized scale parameters of quantized scale factors that are obtained, when the codebook index or the set of codebook indices or, generally, the encoded representation is input into a decoder-side vector decoder or any other decoder.

Advantageously, the spectral processor 120 uses the same set of scale factors that is also available at the decoder-side, i.e., uses the quantized second set of scale parameters together with an interpolation operation to finally obtain the third set of scale factors.

In a advantageous embodiment, the third number of scale factors in the third set of scale factors is equal to the first number of scale factors. However, a smaller number of scale factors is also useful. Exemplarily, for example, one could derive 64 scale factors in block 110, and one could then downsample the 64 scale factors to 16 scale factors for transmission. Then, one could perform an interpolation not necessarily to 64 scale factors, but to 32 scale factors in the spectral processor 120. Alternatively, one could perform an interpolation to an even higher number such as more than 64 scale factors as the case may be, as long as the number of scale factors transmitted in the encoded output signal 170 is smaller than the number of scale factors calculated in block 110 or calculated and used in block 120 of FIG. 1.

Figure 2:
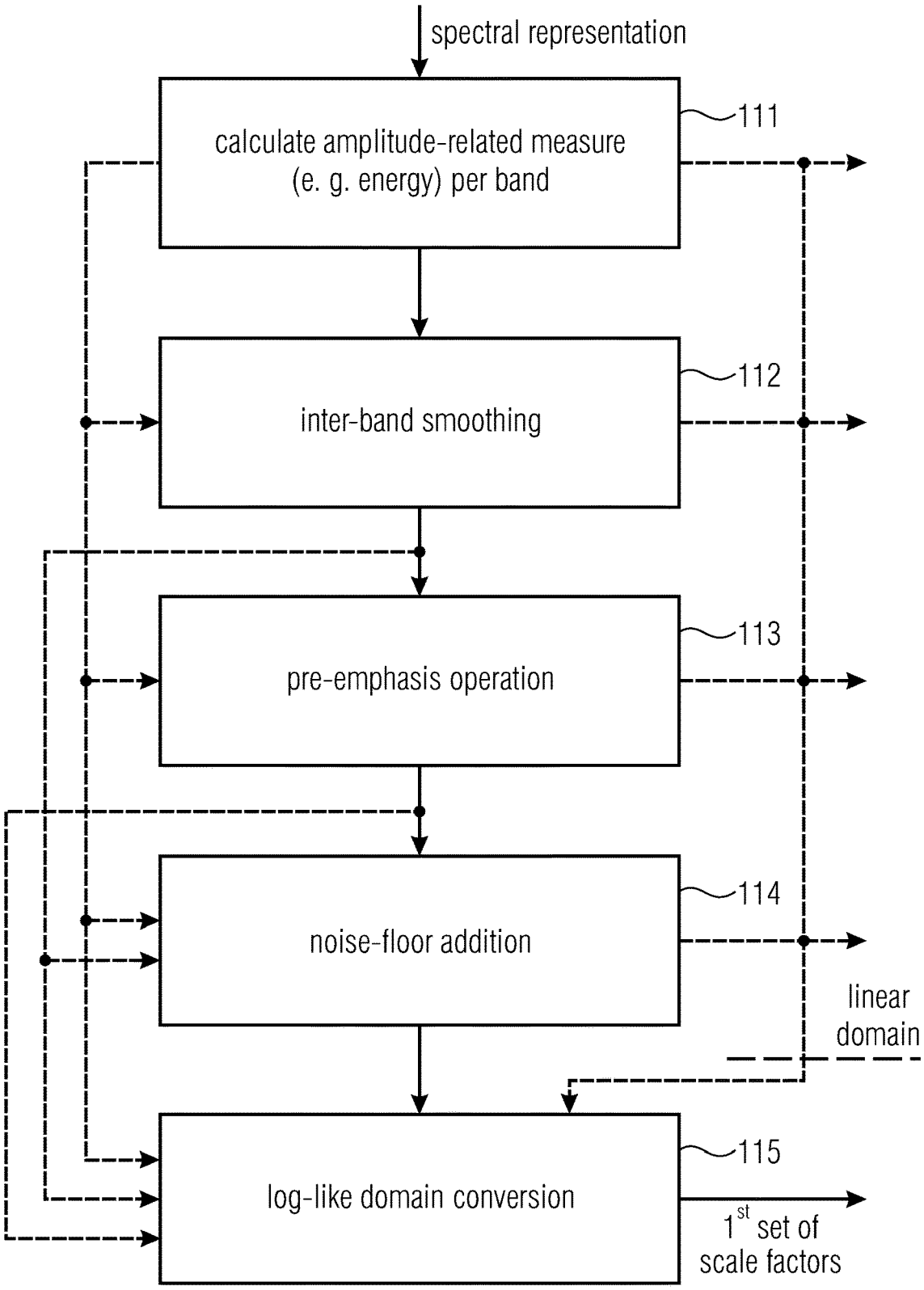
FIG. 2 is a schematic representation of an advantageous implementation of the scale factor calculator of FIG. 1.

Advantageously, the scale factor calculator 110 is configured to perform several operations illustrated in FIG. 2. These operations refer to a calculation 111 of an amplitude-related measure per band. An advantageous amplitude-related measure per band is the energy per band, but other amplitude-related measures can be used as well, for example, the summation of the magnitudes of the amplitudes per band or the summation of squared amplitudes which corresponds to the energy. However, apart from the power of 2 used for calculating the energy per band, other powers such as a power of 3 that would reflect the loudness of the signal could also be used and, even powers different from integer numbers such as powers of 1.5 or 2.5 can be used as well in order to calculate amplitude-related measures per band. Even powers less than 1.0 can be used as long as it is made sure that values processed by such powers are positive-valued.

A further operation performed by the scale factor calculator can be an inter-band smoothing 112. This inter-band smoothing is advantageously used to smooth out the possible instabilities that can appear in the vector of amplitude-related measures as obtained by step 111. If one would not perform this smoothing, these instabilities would be amplified when converted to a log-domain later as illustrated at 115, especially in spectral values where the energy is close to 0. However, in other embodiments, inter-band smoothing is not performed.

A further advantageous operation performed by the scale factor calculator 110 is the pre-emphasis operation 113. This pre-emphasis operation has a similar purpose as a pre-emphasis operation used in an LPC-based perceptual filter of the MDCT-based TCX processing as discussed before with respect to the conventional technology. This procedure increases the amplitude of the shaped spectrum in the low-frequencies that results in a reduced quantization noise in the low-frequencies.

However, depending on the implementation, the pre-emphasis operation—as the other specific operations—does not necessarily have to be performed.

A further optional processing operation is the noise-floor addition processing 114. This procedure improves the quality of signals containing very high spectral dynamics such as, for example, Glockenspiel, by limiting the amplitude amplification of the shaped spectrum in the valleys, which has the indirect effect of reducing the quantization noise in the peaks, at the cost of an increase of quantization noise in the valleys, where the quantization noise is anyway not perceptible due to masking properties of the human ear such as the absolute listening threshold, the pre-masking, the post-masking or the general masking threshold indicating that, typically, a quite low volume tone relatively close in frequency to a high volume tone is not perceptible at all, i.e., is fully masked or is only roughly perceived by the human hearing mechanism, so that this spectral contribution can be quantized quite coarsely.

The noise-floor addition operation 114, however, does not necessarily have to be performed.

Furthermore, block 115 indicates a log-like domain conversion. Advantageously, a transformation of an output of one of blocks 111, 112, 113, 114 in FIG. 2 is performed in a log-like domain. A log-like domain is a domain, in which values close to 0 are expanded and high values are compressed. Advantageously, the log domain is a domain with basis of 2, but other log domains can be used as well. However, a log domain with the basis of 2 is better for an implementation on a fixed-point signal processor.

The output of the scale factor calculator 110 is a first set of scale factors.

As illustrated in FIG. 2, each of the blocks 112 to 115 can be bridged, i.e., the output of block 111, for example, could already be the first set of scale factors. However, all the processing operations and, particularly, the log-like domain conversion may be advantageous. Thus, one could even implement the scale factor calculator by only performing steps 111 and 115 without the procedures in steps 112 to 114, for example.

Thus, the scale factor calculator is configured for performing one or two or more of the procedures illustrated in FIG. 2 as indicated by the input/output lines connecting several blocks.

Figure 3:
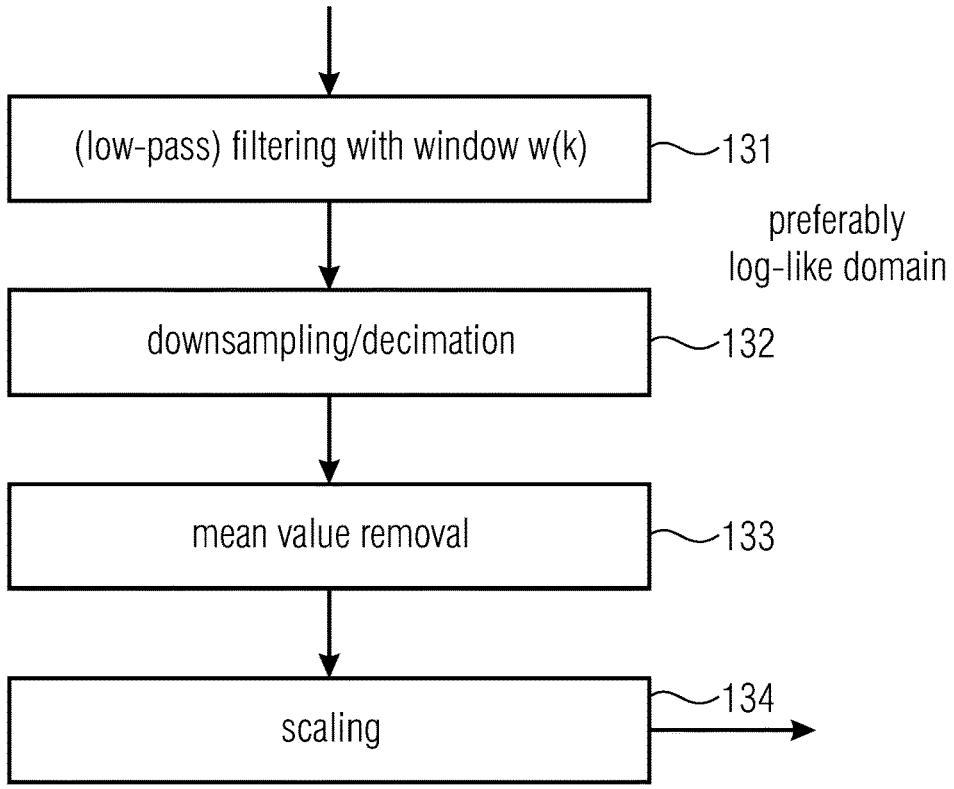
FIG. 3 is a schematic representation of an advantageous implementation of the downsampler of FIG. 1.

FIG. 3 illustrates an advantageous implementation of the downsampler 130 of FIG. 1. Advantageously, a low-pass filtering or, generally, a filtering with a certain window w(k) is performed in step 131, and, then, a downsampling/decimation operation of the result of the filtering is performed. Due to the fact that low-pass filtering 131 and in advantageous embodiments the downsampling/decimation operation 132 are both arithmetic operations, the filtering 131 and the downsampling 132 can be performed within a single operation as will be outlined later on. Advantageously, the downsampling/decimation operation is performed in such a way that an overlap among the individual groups of scale parameters of the first set of scale parameters is performed. Advantageously, an overlap of one scale factor in the filtering operation between two decimated calculated parameters is performed. Thus, step 131 performs a low-pass filter on the vector of scale parameters before decimation. This low-pass filter has a similar effect as the spreading function used in psychoacoustic models. It reduces the quantization noise at the peaks, at the cost of an increase of quantization noise around the peaks where it is anyway perceptually masked at least to a higher degree with respect to quantization noise at the peaks.

Furthermore, the downsampler additionally performs a mean value removal 133 and an additional scaling step 134. However, the low-pass filtering operation 131, the mean value removal step 133 and the scaling step 134 are only optional steps. Thus, the downsampler illustrated in FIG. 3 or illustrated in FIG. 1 can be implemented to only perform step 132 or to perform two steps illustrated in FIG. 3 such as step 132 and one of the steps 131, 133 and 134. Alternatively, the downsampler can perform all four steps or only three steps out of the four steps illustrated in FIG. 3 as long as the downsampling/decimation operation 132 is performed.

As outlined in FIG. 3, audio operations in FIG. 3 performed by the downsampler are performed in the log-like domain in order to obtain better results.

Figure 4:
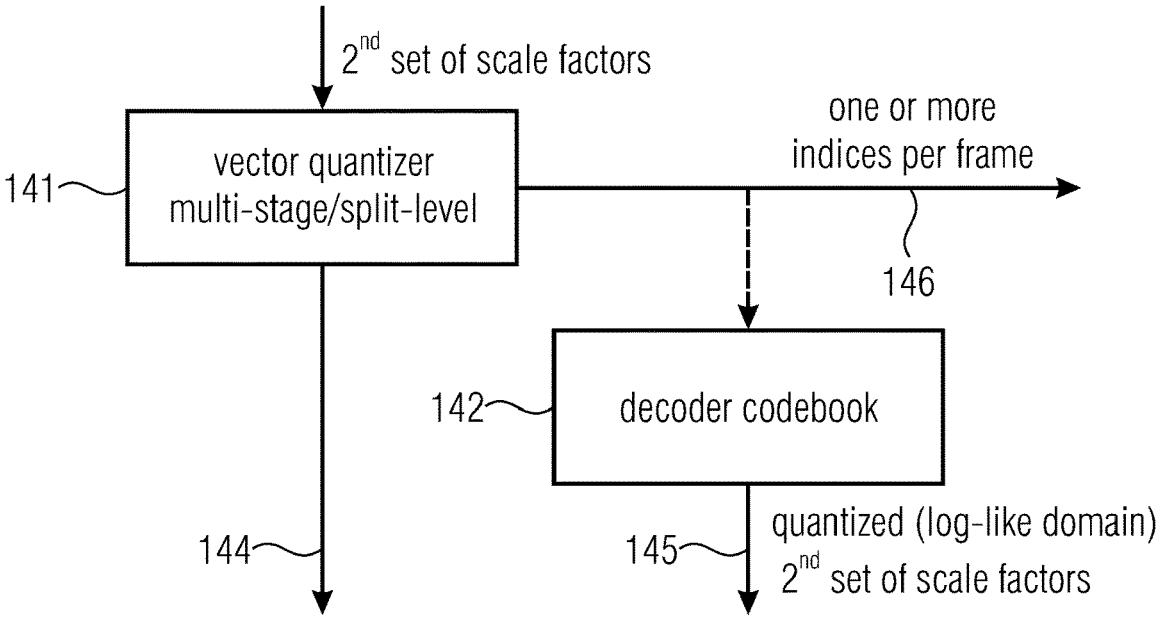
FIG. 4 is a schematic representation of the scale factor encoder of FIG. 4.

FIG. 4 illustrates an advantageous implementation of the scale factor encoder 140. The scale factor encoder 140 receives the advantageously log-like domain second set of scale factors and performs a vector quantization as illustrated in block 141 to finally output one or more indices per frame. These one or more indices per frame can be forwarded to the output interface and written into the bitstream, i.e., introduced into the output encoded audio signal 170 by means of any available output interface procedures. Advantageously, the vector quantizer 141 additionally outputs the quantized log-like domain second set of scale factors. Thus, this data can be directly output by block 141 as indicated by arrow 144. However, alternatively, a decoder codebook 142 is also available separately in the encoder. This decoder codebook receives the one or more indices per frame and derives, from these one or more indices per frame the quantized advantageously log-like domain second set of scale factors as indicated by line 145. In typical implementations, the decoder codebook 142 will be integrated within the vector quantizer 141. Advantageously, the vector quantizer 141 is a multi-stage or split-level or a combined multi-stage/split-level vector quantizer as is, for example, used in any of the indicated conventional technology procedures.

Thus, it is made sure that the second set of scale factors are the same quantized second set of scale factors that are also available on the decoder-side, i.e., in the decoder that only receives the encoded audio signal that has the one or more indices per frame as output by block 141 via line 146.

Figure 5:
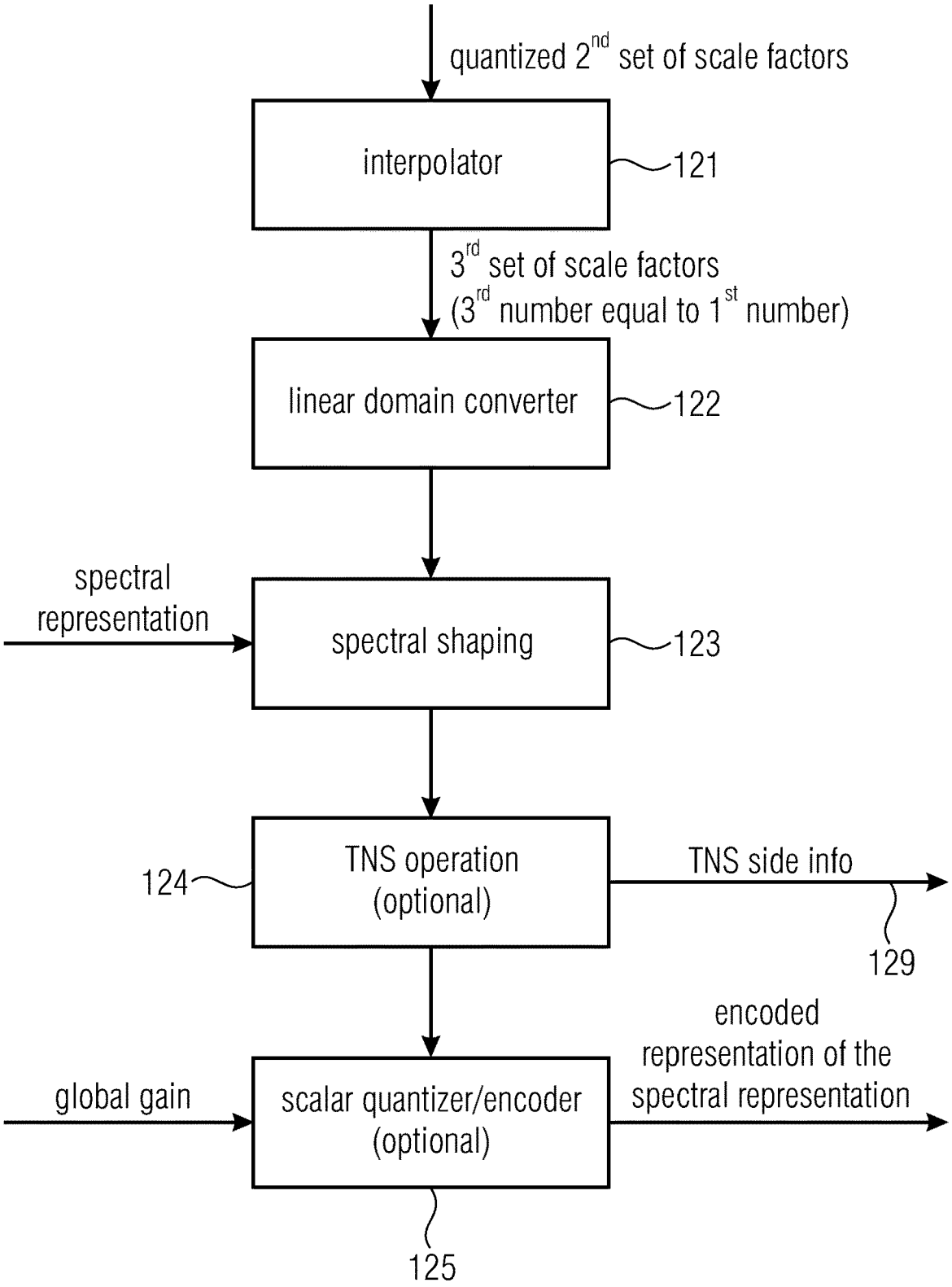
FIG. 5 is a schematic illustration of the spectral processor of FIG. 1.

FIG. 5 illustrates an advantageous implementation of the spectral processor. The spectral processor 120 included within the encoder of FIG. 1 comprises an interpolator 121 that receives the quantized second set of scale parameters and that outputs the third set of scale parameters where the third number is greater than the second number and advantageously equal to the first number. Furthermore, the spectral processor comprises a linear domain converter 120. Then, a spectral shaping is performed in block 123 using the linear scale parameters on the one hand and the spectral representation on the other hand that is obtained by the converter 100. Advantageously, a subsequent temporal noise shaping operation, i.e., a prediction over frequency is performed in order to obtain spectral residual values at the output of block 124, while the TNS side information is forwarded to the output interface as indicated by arrow 129.

Finally, the spectral processor 125 has a scalar quantizer/encoder that is configured for receiving a single global gain for the whole spectral representation, i.e., for a whole frame. Advantageously, the global gain is derived depending on certain bitrate considerations. Thus, the global gain is set so that the encoded representation of the spectral representation generated by block 125 fulfils certain requirements such as a bitrate requirement, a quality requirement or both. The global gain can be iteratively calculated or can be calculated in a feed forward measure as the case may be. Generally, the global gain is used together with a quantizer and a high global gain typically results in a coarser quantization where a low global gain results in a finer quantization. Thus, in other words, a high global gain results in a higher quantization step size while a low global gain results in a smaller quantization step size when a fixed quantizer is obtained. However, other quantizers can be used as well together with the global gain functionality such as a quantizer that has some kind of compression functionality for high values, i.e., some kind of non-linear compression functionality so that, for example, the higher values are more compressed than lower values. The above dependency between the global gain and the quantization coarseness is valid, when the global gain is multiplied to the values before the quantization in the linear domain corresponding to an addition in the log domain. If, however, the global gain is applied by a division in the linear domain, or by a subtraction in the log domain, the dependency is the other way round. The same is true, when the "global gain" represents an inverse value.

Subsequently, advantageous implementations of the individual procedures described with respect to FIG. 1 to FIG. 5 are given.

Detailed Step-by-Step Description of Advantageous Embodiments

Encoder:

Step 1: Energy Per Band (111)

The energies per band $E_B(n)$ are computed as follows:

$$E_B(b) = \sum_{k=Ind(b)}^{Ind(b+1)-1} \frac{X(k)^2}{Ind(b+1) - Ind(b)} \text{ for } b = 0 \ldots N_B - 1$$

with X(k) are the MDCT coefficients, $N_B$=64 is the number of bands and Ind(n) are the band indices. The bands are non-uniform and follow the perceptually-relevant bark scale (smaller in low-frequencies, larger in high-frequencies).

Step 2: Smoothing (112)

The energy per band $E_B(b)$ is smoothed using $$E_S(b) = \begin{cases} 0.75 \cdot E_B(0) + 0.25 \cdot E_B(1), & \text{if } b = 0 \\ 0.25 \cdot E_B(62) + 0.75 \cdot E_B(63), & \text{if } b = 63 \\ 0.25 \cdot E_B(b+1) + 0.5 \cdot E_B(b) + 0.25 \cdot E_B(b+1), & \text{otherwise} \end{cases}$$

Remark: this step is mainly used to smooth the possible instabilities that can appear in the vector $E_B(b)$. If not smoothed, these instabilities are amplified when converted to log-domain (see step 5), especially in the valleys where the energy is close to 0.

Step 3: Pre-Emphasis (113)

The smoothed energy per band $E_S(b)$ is then pre-emphasized using $$E_P(b) = E_S(b) \cdot 10^{\frac{b \cdot g_{tilt}}{10 \cdot 63}} \text{ for } b = 0 \ldots 63$$

with $g_{tilt}$ controls the pre-emphasis tilt and depends on the sampling frequency. It is for example 18 at 16 kHz and 30 at 48 kHz. The pre-emphasis used in this step has the same purpose as the pre-emphasis used in the LPC-based perceptual filter of conventional technology 2, it increases the amplitude of the shaped Spectrum in the low-frequencies, resulting in reduced quantization noise in the low-frequencies.

Step 4: Noise Floor (114)

A noise floor at −40 dB is added to $E_P(b)$ using $$E_P(b) = \max(E_P(b), \text{noiseFloor}) \text{ for } b = 0 \ldots 63$$

with the noise floor being calculated by $$noiseFloor = \max\left(\frac{\sum_{b=0}^{63} E_P(b)}{64} \cdot 10^{-\frac{40}{10}}, 2^{-32}\right)$$

This step improves quality of signals containing very high spectral dynamics such as e.g. glockenspiel, by limiting the amplitude amplification of the shaped spectrum in the valleys, which has the indirect effect of reducing the quantization noise in the peaks, at the cost of an increase of quantization noise in the valleys where it is anyway not perceptible.

Step 5: Logarithm (115)

A transformation into the logarithm domain is then performed using $$E_L(b) = \frac{\log_2(E_P(b))}{2} \text{ for } b = 0 \ldots 63$$

Step 6: Downsampling (131, 132)

The vector $E_L$ (b) is then downsampled by a factor of 4 using $$E_4(b) = \begin{cases} w(0)E_L(0) + \sum_{k=1}^{5} w(k)E_L(4b+k-1), & \text{if } b = 0 \\ \sum_{k=0}^{4} w(k)E_L(4b+k-1) + w(5)E_L(63), & \text{if } b = 15 \\ \sum_{k=0}^{5} w(k)E_L(4b+k-1), & \text{otherwise} \end{cases}$$

With $$w(k) = \left\{\frac{1}{12}, \frac{2}{12}, \frac{3}{12}, \frac{3}{12}, \frac{2}{12}, \frac{1}{12}\right\}$$

This step applies a low-pass filter (w(k)) on the vector $E_L$(b) before decimation. This low-pass filter has a similar effect as the spreading function used in psychoacoustic models: it reduces the quantization noise at the peaks, at the cost of an increase of quantization noise around the peaks where it is anyway perceptually masked.

Step 7: Mean Removal and Scaling (133, 134)

The final scale factors are obtained after mean removal and scaling by a factor of 0.85

$$scf(n) = 0.85\left(E_4(n) - \frac{\sum_{b=0}^{15} E_4(b)}{16}\right) \text{ for } n = 0 \ldots 15$$

Since the codec has an additional global-gain, the mean can be removed without any loss of information. Removing the mean also allows more efficient vector quantization. The scaling of 0.85 slightly compress the amplitude of the noise shaping curve. It has a similar perceptual effect as the spreading function mentioned in Step 6: reduced quantization noise at the peaks and increased quantization noise in the valleys.

Step 8: Quantization (141, 142)

The scale factors are quantized using vector quantization, producing indices which are then packed into the bitstream and sent to the decoder, and quantized scale factors scfQ(n).

Step 9: Interpolation (121, 122)

The quantized scale factors scfQ(n) are interpolated using $$scfQint(0) = scfQ(0)$$

$$scfQint(1) = scfQ(0)$$

$$scfQint(4n+2) = scfQ(n) + \frac{1}{8}(scfQ(n+1) - scfQ(n)) \text{ for } n = 0 \ldots 14$$

$$scfQint(4n+3) = scfQ(n) + \frac{3}{8}(scfQ(n+1) - scfQ(n)) \text{ for } n = 0 \ldots 14$$

-continued $$scfQint(4n+4) = scfQ(n) + \frac{5}{8}(scfQ(n+1) - scfQ(n)) \text{ for } n = 0 \ldots 14$$

$$scfQint(4n+5) = scfQ(n) + \frac{7}{8}(scfQ(n+1) - scfQ(n)) \text{ for } n = 0 \ldots 14$$

$$scfQint(62) = scfQ(15) + \frac{1}{8}(scfQ(15) - scfQ(14))$$

$$scfQint(63) = scfQ(15) + \frac{3}{8}(scfQ(15) - scfQ(14))$$

and transformed back into linear domain using $$g_{SNS}(b) = 2^{scfQint(b)} \text{ for } b = 0 \ldots 63$$

Interpolation is used to get a smooth noise shaping curve and thus to avoid any big amplitude jumps between adjacent bands.

Step 10: Spectral Shaping (123)

The SNS scale factors $g_{SNS}$(b) are applied on the MDCT frequency lines for each band separately in order to generate the shaped spectrum $X_s$(k)

$$X_s(k) = \frac{X(k)}{g_{SNS}(b)} \text{ for } k = Ind(b) \ldots Ind(b+1) - 1, \text{ for } b = 0 \ldots 63$$

Figure 8:
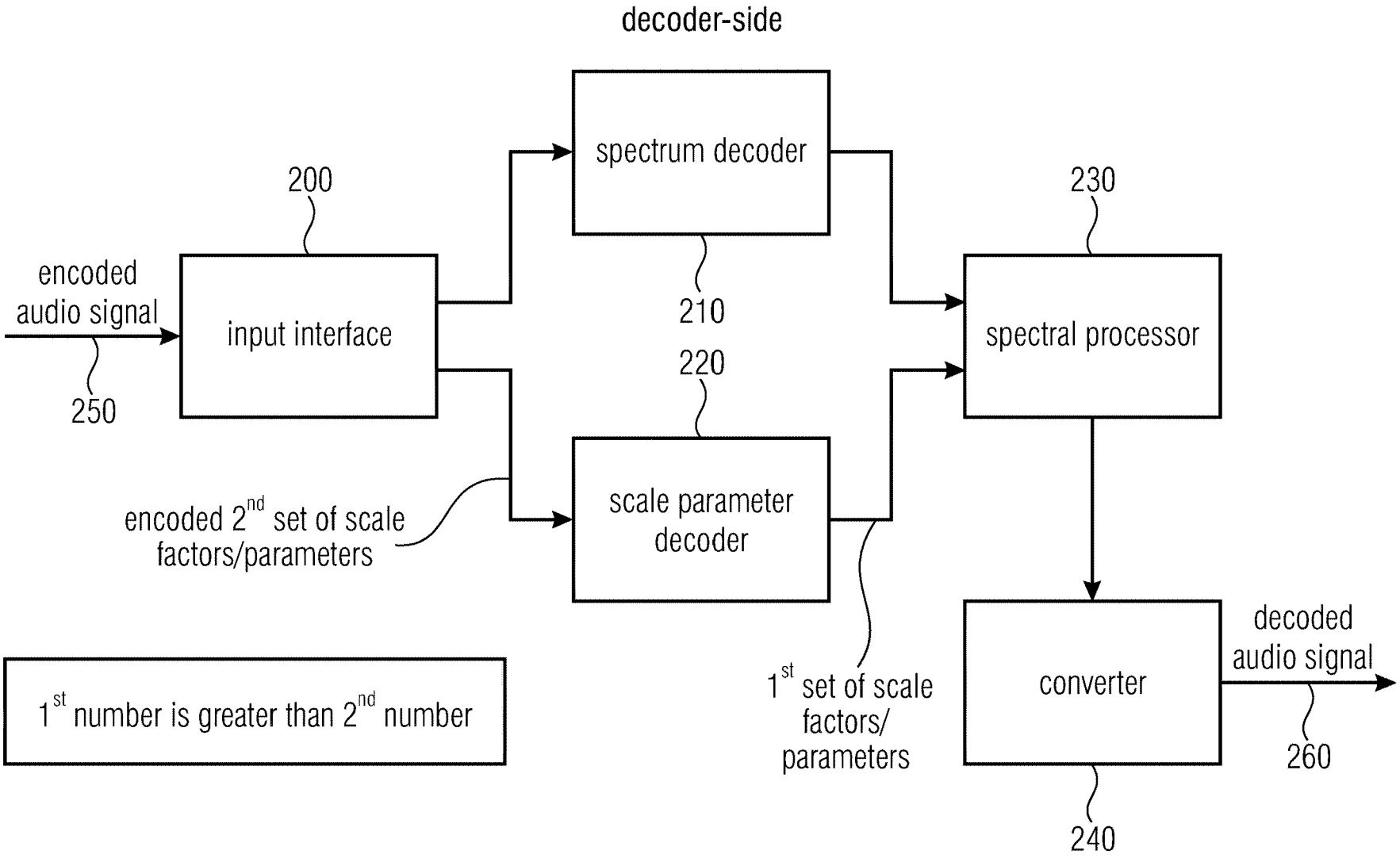
FIG. 8 illustrates a block diagram of an apparatus for decoding an encoded audio signal.

FIG. 8 illustrates an advantageous implementation of an apparatus for decoding an encoded audio signal 250 comprising information on an encoded spectral representation and information on an encoded representation of a second set of scale parameters. The decoder comprises an input interface 200, a spectrum decoder 210, a scale factor/parameter decoder 220, a spectral processor 230 and a converter 240. The input interface 200 is configured for receiving the encoded audio signal 250 and for extracting the encoded spectral representation that is forwarded to the spectrum decoder 210 and for extracting the encoded representation of the second set of scale factors that is forwarded to the scale factor decoder 220. Furthermore, the spectrum decoder 210 is configured for decoding the encoded spectral representation to obtain a decoded spectral representation that is forwarded to the spectral processor 230. The scale factor decoder 220 is configured for decoding the encoded second set of scale parameters to obtain a first set of scale parameters forwarded to the spectral processor 230. The first set of scale factors has a number of scale factors or scale parameters that is greater than the number of scale factors or scale parameters in the second set. The spectral processor 230 is configured for processing the decoded spectral representation using the first set of scale parameters to obtain a scaled spectral representation. The scaled spectral representation is then converted by the converter 240 to finally obtain the decoded audio signal 260.

Figure 9:
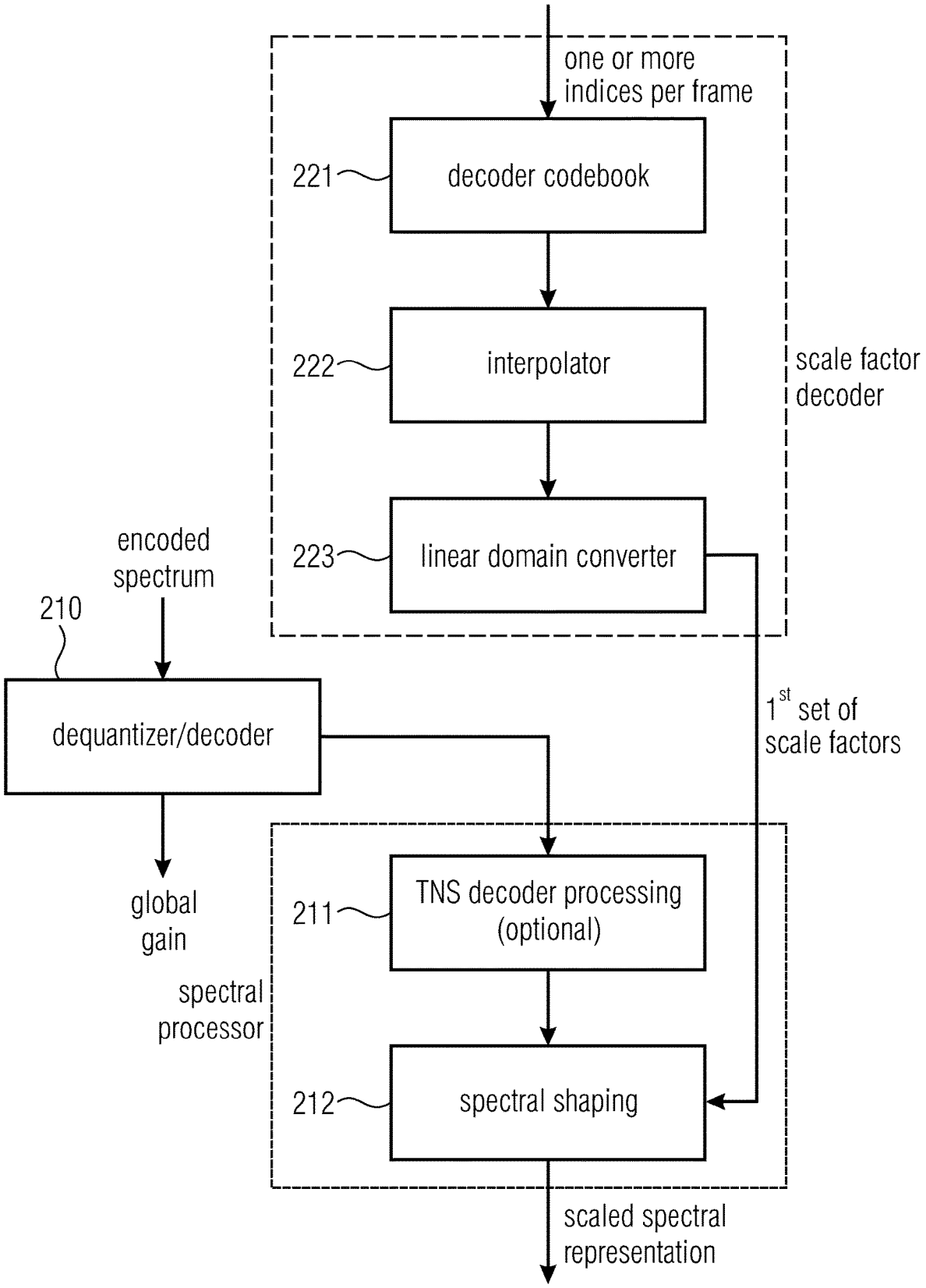
FIG. 9 illustrates a schematic illustration illustrating details of the scale factor decoder, the spectral processor and the spectrum decoder of FIG. 8.

Advantageously, the scale factor decoder 220 is configured to operate in substantially the same manner as has been discussed with respect to the spectral processor 120 of FIG. 1 relating to the calculation of the third set of scale factors or scale parameters as discussed in connection with blocks 141 or 142 and, particularly, with respect to blocks 121, 122 of FIG. 5. Particularly, the scale factor decoder is configured to perform the substantially same procedure for the interpolation and the transformation back into the linear domain as has been discussed before with respect to step 9. Thus, as illustrated in FIG. 9, the scale factor decoder 220 is configured for applying a decoder codebook 221 to the one or more indices per frame representing the encoded scale parameter representation. Then, an interpolation is performed in block 222 that is substantially the same interpolation as has been discussed with respect to block 121 in FIG. 5. Then, a linear domain converter 223 is used that is substantially the same linear domain converter 122 as has been discussed with respect to FIG. 5. However, in other implementations, blocks 221, 222, 223 can operate different from what has been discussed with respect to the corresponding blocks on the encoder-side.

Furthermore, the spectrum decoder 210 illustrated in FIG. 8 comprises a dequantizer/decoder block that receives, as an input, the encoded spectrum and that outputs a dequantized spectrum that is advantageously dequantized using the global gain that is additionally transmitted from the encoder side to the decoder side within the encoded audio signal in an encoded form. The dequantizer/decoder 210 can, for example, comprise an arithmetic or Huffman decoder functionality that receives, as an input, some kind of codes and that outputs quantization indices representing spectral values. Then, these quantization indices are input into a dequantizer together with the global gain and the output are dequantized spectral values that can then be subjected to a TNS processing such as an inverse prediction over frequency in a TNS decoder processing block 211 that, however, is optional. Particularly, the TNS decoder processing block additionally receives the TNS side information that has been generated by block 124 of FIG. 5 as indicated by line 129. The output of the TNS decoder processing step 211 is input into a spectral shaping block 212, where the first set of scale factors as calculated by the scale factor decoder are applied to the decoded spectral representation that can or cannot be TNS processed as the case may be, and the output is the scaled spectral representation that is then input into the converter 240 of FIG. 8.

Further procedures of advantageous embodiments of the decoder are discussed subsequently.

Decoder:

Step 1: Quantization (221)

The vector quantizer indices produced in encoder step 8 are read from the bitstream and used to decode the quantized scale factors scfQ(n).

Step 2: Interpolation (222, 223)

Same as Encoder Step 9.

Step 3: Spectral Shaping (212)

The SNS scale factors $g_{SNS}(b)$ are applied on the quantized MDCT frequency lines for each band separately in order to generate the decoded spectrum $\hat{X}(k)$ as outlined by the following code.

$$\hat{X}(k)=\hat{X}_S(sk)\cdot g_{SNS}(b) \text{ for } k=Ind(b) \ldots Ind(b+1)-1, \text{ for } b=0 \ldots 63$$

Figure 6:
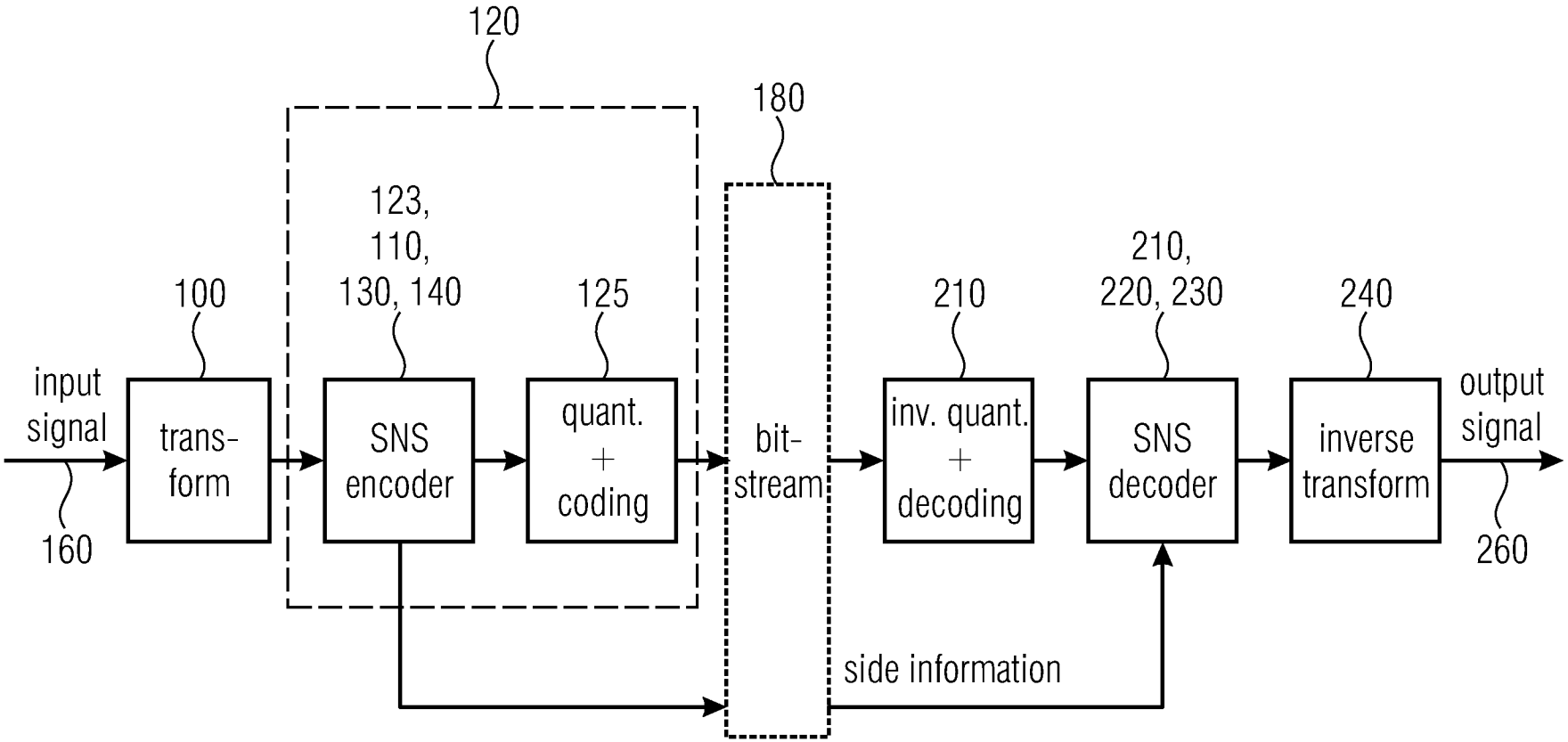
FIG. 6 illustrates a general representation of an encoder on the one hand and a decoder on the other hand implementing spectral noise shaping (SNS)
Figure 7:
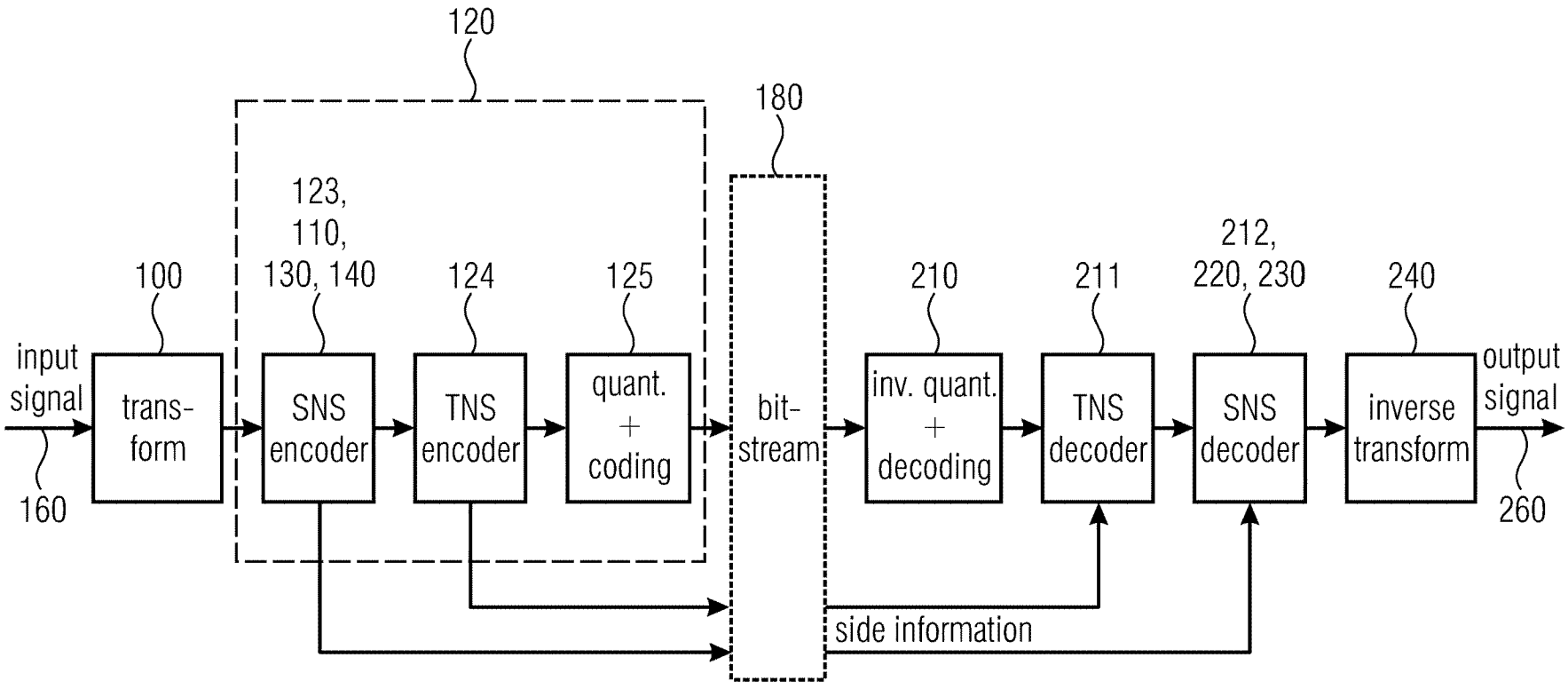
FIG. 7 illustrates a more detailed representation of the encoder-side on the one hand and the decoder-side on the other hand where temporal noise shaping (TNS) is implemented together with spectral noise shaping (SNS)

FIG. 6 and FIG. 7 illustrate a general encoder/decoder setup where FIG. 6 represents an implementation without TNS processing, while FIG. 7 illustrates an implementation that comprises TNS processing. Similar functionalities illustrated in FIG. 6 and FIG. 7 correspond to similar functionalities in the other figures when identical reference numerals are indicated. Particularly, as illustrated in FIG. 6, the input signal 160 is input into a transform stage 110 and, subsequently, the spectral processing 120 is performed. Particularly, the spectral processing is reflected by an SNS encoder indicated by reference numerals 123, 110, 130, 140 indicating that the block SNS encoder implements the functionalities indicated by these reference numerals. Subsequently to the SNS encoder block, a quantization encoding operation 125 is performed, and the encoded signal is input into the bitstream as indicated at 180 in FIG. 6. The bitstream 180 then occurs at the decoder-side and subsequent to an inverse quantization and decoding illustrated by reference numeral 210, the SNS decoder operation illustrated by blocks 210, 220, 230 of FIG. 8 are performed so that, in the end, subsequent to an inverse transform 240, the decoded output signal 260 is obtained.

FIG. 7 illustrates a similar representation as in FIG. 6, but it is indicated that, advantageously, the TNS processing is performed subsequent to SNS processing on the encoder-side and, correspondingly, the TNS processing 211 is performed before the SNS processing 212 with respect to the processing sequence on the decoder-side.

Advantageously the additional tool TNS between Spectral Noise Shaping (SNS) and quantization/coding (see block diagram below) is used. TNS (Temporal Noise Shaping) also shapes the quantization noise but does a time-domain shaping (as opposed to the frequency-domain shaping of SNS) as well. TNS is useful for signals containing sharp attacks and for speech signals.

TNS is usually applied (in AAC for example) between the transform and SNS. Advantageously, however, it may be advantageous to apply TNS on the shaped spectrum. This avoids some artifacts that were produced by the TNS decoder when operating the codec at low bitrates.

Figure 10:
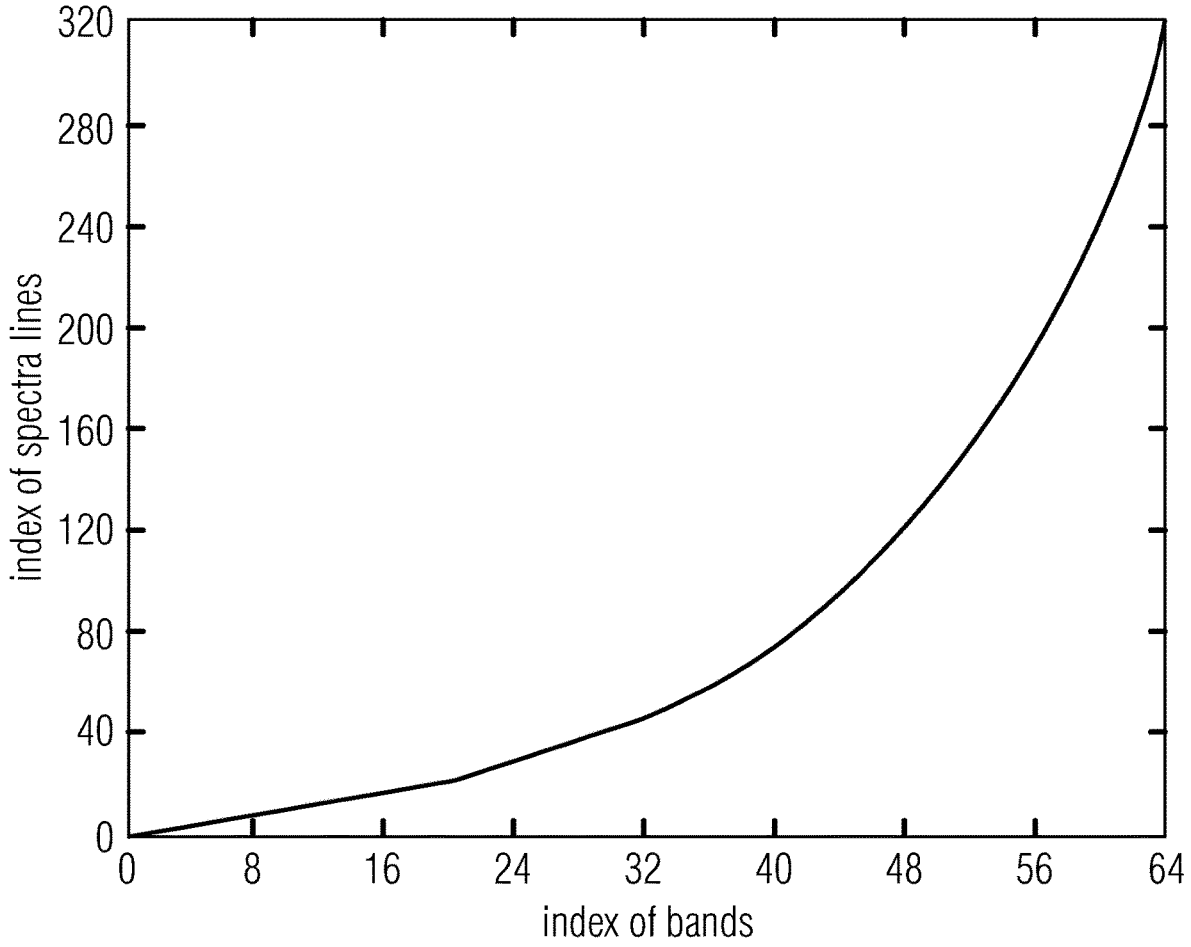
FIG. 10 illustrates a subdivision of the spectrum into 64 bands.

FIG. 10 illustrates an advantageous subdivision of the spectral coefficients or spectral lines as obtained by block 100 on the encoder-side into bands. Particularly, it is indicated that lower bands have a smaller number of spectral lines than higher bands.

Particularly, the x-axis in FIG. 10 corresponds to the index of bands and illustrates the advantageous embodiment of 64 bands and the y-axis corresponds to the index of the spectral lines illustrating 320 spectral coefficients in one frame. Particularly, FIG. 10 illustrates exemplarily the situation of the super wide band (SWB) case where there is a sampling frequency of 32 kHz.

For the wide band case, the situation with respect to the individual bands is so that one frame results in 160 spectral lines and the sampling frequency is 16 kHz so that, for both cases, one frame has a length in time of 10 milliseconds.

Figure 11:
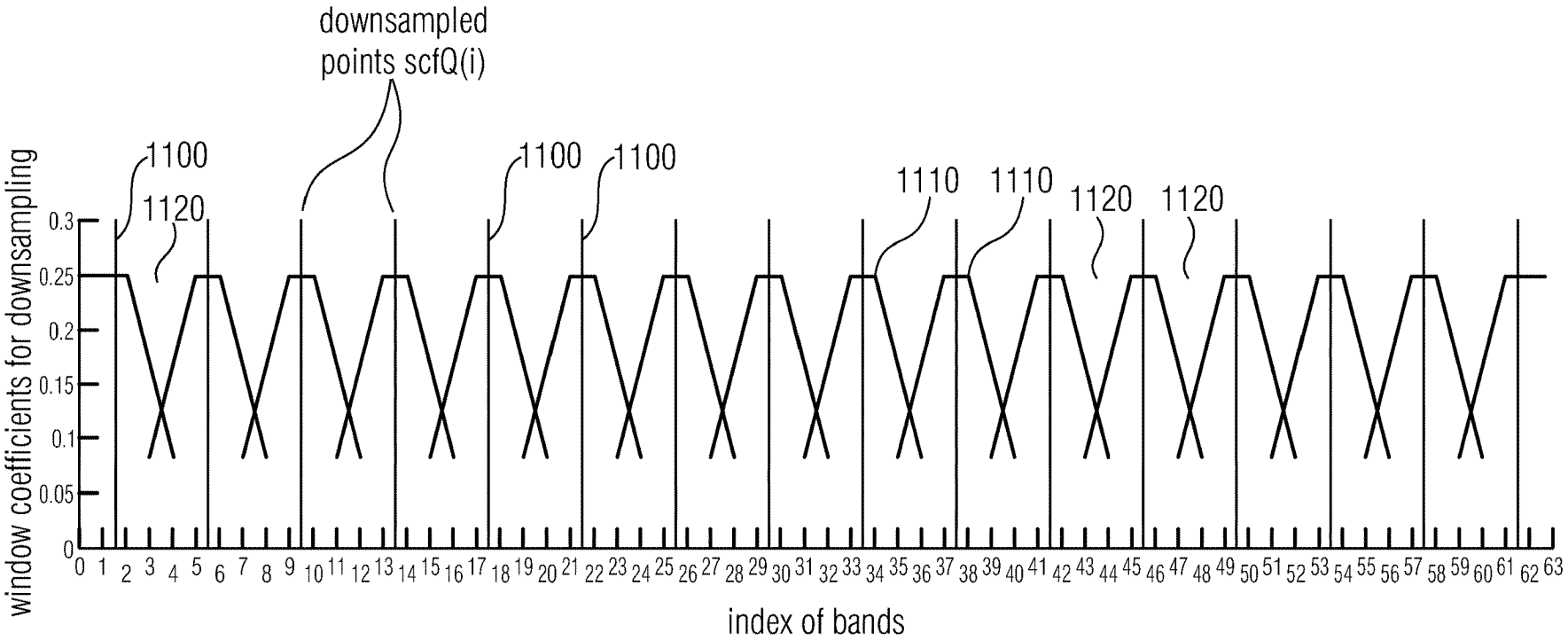
FIG. 11 illustrates a schematic illustration of the downsampling operation on the one hand and the interpolation operation on the other hand.

FIG. 11 illustrates more details on the advantageous downsampling performed in the downsampler 130 of FIG. 1 or the corresponding upsampling or interpolation as performed in the scale factor decoder 220 of FIG. 8 or as illustrated in block 222 of FIG. 9.

Along the x-axis, the index for the bands 0 to 63 is given. Particularly, there are 64 bands going from 0 to 63.

The 16 downsample points corresponding to scfQ(i) are illustrated as vertical lines 1100. Particularly, FIG. 11 illustrates how a certain grouping of scale parameters is performed to finally obtain the downsampled point 1100. Exemplarily, the first block of four bands consists of (0, 1, 2, 3) and the middle point of this first block is at 1.5 indicated by item 1100 at the index 1.5 along the x-axis.

Correspondingly, the second block of four bands is (4, 5, 6, 7), and the middle point of the second block is 5.5.

The windows 1110 correspond to the windows w(k) discussed with respect to the step 6 downsampling described before. It can be seen that these windows are centered at the downsampled points and there is the overlap of one block to each side as discussed before.

The interpolation step 222 of FIG. 9 recovers the 64 bands from the 16 downsampled points. This is seen in FIG. 11 by computing the position of any of the lines 1120 as a function of the two downsampled points indicated at 1100 around a certain line 1120. The following example exemplifies that.

The position of the second band is calculated as a function of the two vertical lines around it (1.5 and 5.5): 2=1.5+1/8×(5.5−1.5).

Correspondingly, the position of the third band as a function of the two vertical lines 1100 around it (1.5 and 5.5): 3=1.5+3/8×(5.5−1.5).

A specific procedure is performed for the first two bands and the last two bands. For these bands, an interpolation cannot be performed, because there would not exist vertical lines or values corresponding to vertical lines 1100 outside the range going from 0 to 63. Thus, in order to address this issue, an extrapolation is performed as described with respect to step 9: interpolation as outlined before for the two bands 0, 1 on the one hand and 62 and 63 on the other hand.

Subsequently, an advantageous implementation of the converter 100 of FIG. 1 on the one hand and the converter 240 of FIG. 8 on the other hand are discussed.

Figure 12A:
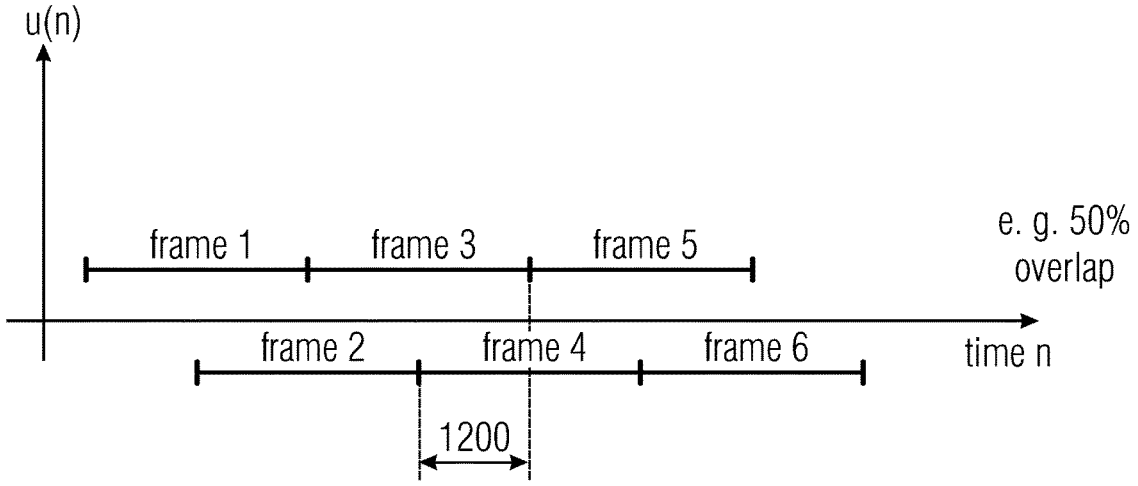
FIG. 12*a* illustrates a time-domain audio signal with overlapping frames.
Figure 12B:
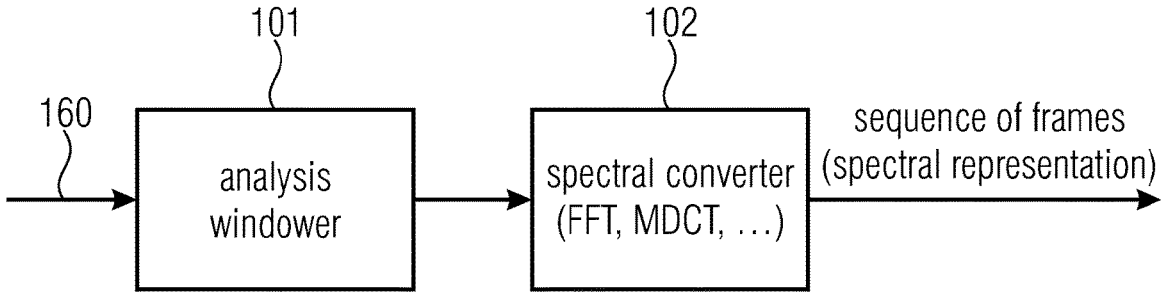
FIG. 12*b* illustrates an implementation of the converter of FIG. 1.
Figure 12C:
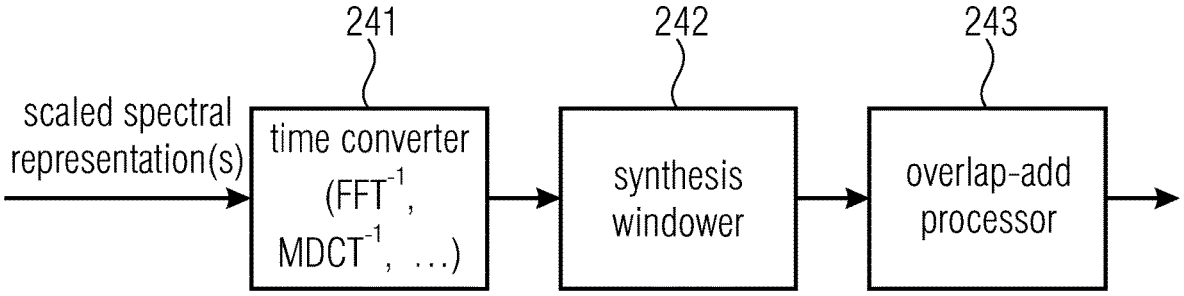
FIG. 12*c* illustrates a schematic illustration of the converter of FIG. 8.

Particularly, FIG. 12*a* illustrates a schedule for indicating the framing performed on the encoder-side within converter 100. FIG. 12*b* illustrates an advantageous implementation of the converter 100 of FIG. 1 on the encoder-side and FIG. 12*c* illustrates an advantageous implementation of the converter 240 on the decoder-side.

The converter 100 on the encoder-side is advantageously implemented to perform a framing with overlapping frames such as a 50% overlap so that frame 2 overlaps with frame 1 and frame 3 overlaps with frame 2 and frame 4. However, other overlaps or a non-overlapping processing can be performed as well, but it may be advantageous to perform a 50% overlap together with an MDCT algorithm. To this end, the converter 100 comprises an analysis window 101 and a subsequently-connected spectral converter 102 for performing an FFT processing, an MDCT processing or any other kind of time-to-spectrum conversion processing to obtain a sequence of frames corresponding to a sequence of spectral representations as input in FIG. 1 to the blocks subsequent to the converter 100.

Correspondingly, the scaled spectral representation(s) are input into the converter 240 of FIG. 8. Particularly, the converter comprises a time-converter 241 implementing an inverse FFT operation, an inverse MDCT operation or a corresponding spectrum-to-time conversion operation. The output is inserted into a synthesis window 242 and the output of the synthesis window 242 is input into an overlap-add processor 243 to perform an overlap-add operation in order to finally obtain the decoded audio signal. Particularly, the overlap-add processing in block 243, for example, performs a sample-by-sample addition between corresponding samples of the second half of, for example, frame 3 and the first half of frame 4 so that the audio sampling values for the overlap between frame 3 and frame 4 as indicated by item 1200 in FIG. 12*a* is obtained. Similar overlap-add operations in a sample-by-sample manner are performed to obtain the remaining audio sampling values of the decoded audio output signal.

An inventively encoded audio signal can be stored on a digital storage medium or a non-transitory storage medium or can be transmitted on a transmission medium such as a wireless transmission medium or a wired transmission medium such as the Internet.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

BIBLIOGRAPHY

[1] ISO/IEC 14496-3:2001; Information technology—Coding of audio-visual objects—Part 3: Audio.

[2] 3GPP TS 26.403; General audio codec audio processing functions; Enhanced aacPlus general audio codec; Encoder specification; Advanced Audio Coding (AAC) part.

[3] ISO/IEC 23003-3; Information technology—MPEG audio technologies—Part 3: Unified speech and audio coding.

[4] 3GPP TS 26.445; Codec for Enhanced Voice Services (EVS); Detailed algorithmic description.

The invention claimed is:

1. An apparatus for encoding an audio signal, comprising:

a converter for converting the audio signal into a spectral representation;

a scale parameter calculator for calculating a first set of scale parameters from the spectral representation:

a downsampler for downsampling the first set of scale parameters to acquire a second set of scale parameters, wherein a second number of scale parameters in the second set of scale parameters is lower than a first number of scale parameters in the first set of scale parameters;

a scale parameter encoder for generating an encoded representation of the second set of scale parameters;

a spectral processor for processing the spectral representation using a third set of scale parameters, the third set of scale parameters comprising a third number of scale parameters being greater than the second number of scale parameters, wherein the spectral processor is configured to use the first set of scale parameters or to derive the third set of scale parameters from the second set of scale parameters or from the encoded representation of the second set of scale parameters using an interpolation operation; and an output interface for generating an encoded output signal comprising information on the encoded representation of the spectral representation and information on the encoded representation of the second set of scale parameters.

2. The apparatus of claim 1, wherein the scale parameter calculator is configured to calculate, for each band of a plurality of bands of the spectral representation, an amplitude-related measure in a linear domain to acquire a first set of linear domain measures;

to transform the first set of linear-domain measures into a log-like domain to acquire the first set of log-like domain measures; and wherein the downsampler is configured to downsample the first set of scale factors in the log-like domain to acquire the second set of scale factors in the log-like domain.

3. The apparatus of claim 2, wherein the spectral processor is configured to use the first set of scale parameters in the linear domain for processing the spectral representation or to interpolate the second set of scale parameters in the log-like domain to acquire interpolated log-like domain scale factors and to transform the log-like domain scale factors into a linear domain to acquire the third set of scale parameters.

4. The apparatus of claim 1, wherein the scale parameter calculator is configured to calculate the first set of scale parameters for non-uniform bands, and wherein the downsampler is configured to downsample the first set of scale parameters to acquire a first scale factor of the second set by combining a first group comprising a first predefined number of frequency adjacent scale parameters of the first set, and wherein the downsampler is configured to downsample the first set of scale parameters to acquire a second scale parameter of the second set by combining a second group comprising a second predefined number of frequency adjacent scale parameters of the first set, wherein the second predefined number is equal to the first predefined number, and wherein the second group comprises members that are different from members of the first predefined group.

5. The apparatus of claim 4, wherein the first group of frequency adjacent scale parameters of the first set and the second group of frequency adjacent scale parameters of the first set comprise at least one scale parameter of the first set in common, so that the first group and the second group overlap with each other.

6. The apparatus of claim 1, wherein the downsampler is configured to use an average operation among a group of first scale parameters, the group comprising two or more members.

7. The apparatus of claim 6, wherein the average operation is a weighted average operation configured to weight a scale parameter in a middle of the group stronger than a scale parameter at an edge of the group.

8. The apparatus of claim 1, wherein the downsampler is configured to perform a mean value removal so that the second set of scale parameters is mean free.

9. The apparatus of claim 1, wherein the downsampler is configured to perform a scaling operation using a scaling factor lower than 1.0 and greater than 0.0 in a log-like domain.

10. The apparatus of claim 1, wherein the scale parameter encoder is configured to quantize and encode the second set using a vector quantizer, wherein the encoded representation comprises one or more indices for one or more vector quantizer codebooks.

11. The apparatus of claim 1, wherein the scale factor encoder is configured to provide a second set of quantized scale factors associated with the encoded representation, and wherein the spectral processor is configured to derive the second set of scale factors from the second set of quantized scale factors.

12. The apparatus of claim 1, wherein the spectral processor is configured to determine this third set of scale parameters so that the third number is equal to the first number.

13. The apparatus of claim 1, wherein the spectral processor is configured to determine an interpolated scale factor based on a quantized scale factor and a difference between the quantized scale factor and a next quantized scale factor in an ascending sequence of quantized scale factors with respect to frequency.

14. The apparatus of claim 13, wherein the spectral processor is configured to determine, from the quantized scale factor and the difference, at least two interpolated scale factors, wherein for each of the two interpolated scale factors, a different weighting factor is used.

15. The apparatus of claim 14, wherein the weighting factors increase with increasing frequencies associated with the interpolated scale factors.

16. The apparatus of claim 1, wherein the spectral processor is configured to perform the interpolation operation in a log-like domain, and to convert interpolated scale factors into a linear domain to acquire the third set of scale parameters.

17. The apparatus of claim 1, wherein the scale parameter calculator is configured to calculate an amplitude-related measure for each band to acquire a set of amplitude-related measures, and to smooth, the energy-related measures to acquire a set of smoothed amplitude-related measures as the first set of scale factors.

18. The apparatus of claim 1, wherein the scale parameter calculator is configured to calculate an amplitude-related measure for each band to acquire a set of amplitude-related measures, and to perform a pre-emphasis operation to the set of amplitude-related measures, wherein the pre-emphasis operation is so that low frequency amplitudes are emphasized with respect to high frequency amplitudes.

19. The apparatus of claim 1, wherein the scale parameter calculator is configured to calculate an amplitude-related measure for each band to acquire a set of amplitude-related measures, and to perform a noise-floor addition operation, wherein a noise floor is calculated from an amplitude-related measure derived as a mean value from two or more frequency bands of the spectral representation.

20. The apparatus of claim 1, wherein the scale factor calculator is configured to perform at least one of a group of operations, the group of operations comprising calculating amplitude-related measures for a plurality of bands, performing a smoothing operation, performing a pre-emphasis operation, performing a noise-floor addition operation, and performing a log-like domain conversion operation to acquire the first set of scale parameters.

21. The apparatus of claim 1, wherein the spectral processor is configured to weight spectral values in the spectral representation using the third set of scale factors to acquire a weighted spectral representation and to apply a temporal noise shaping (TNS) operation onto the weighted spectral representation, and wherein the spectral processor is configured to quantize and encode a result of the temporal noise shaping operation to acquire the encoded representation of the spectral representation.

22. The apparatus of claim 1, wherein the converter comprises an analysis windower to generate a sequence of blocks of windowed audio samples, and a time-spectrum converter for converting the blocks of windowed audio samples into a sequence of spectral representations, a spectral representation being a spectral frame.

23. The apparatus of claim 1, wherein the converter is configured to apply an MDCT (modified discrete cosine transform) operation to acquire an MDCT spectrum from a block of time domain samples, or wherein the scale factor calculator is configured to calculate, for each band, an energy of the band, the calculation comprising squaring spectral lines, adding squared spectral lines and dividing the squared spectral lines by a number of lines in the band, or wherein the spectral processor is configured to weight spectral values of the spectral representation or to weight spectral values derived from the spectral representation in accordance with a band scheme, the band scheme being identical to the band scheme used in calculating the first set of scale factors by the scale factor calculator, or wherein a number of bands is 64, the first number is 64, the second number is 16, and third number is 64, or wherein the spectral processor is configured to calculate a global gain for all bands and to quantize the spectral values subsequent to a scaling involving the third number of scale factors using a scalar quantizer, wherein the spectral processor is configured to control a step size of the scalar quantizer dependent on the global gain.

24. A method for encoding an audio signal, comprising:

converting the audio signal into a spectral representation;

calculating a first set of scale parameters from the spectral representation:

downsampling the first set of scale parameters to acquire a second set of scale parameters, wherein a second number of scale parameters in the second set of scale parameters is lower than a first number of scale parameters in the first set of scale parameters;

generating an encoded representation of the second set of scale parameters;

processing the spectral representation using a third set of scale parameters, the third set of scale parameters comprising a third number of scale parameters being greater than the second number of scale parameters, wherein the processing uses the first set of scale parameters or derives the third set of scale parameters from the second set of scale parameters or from the encoded representation of the second set of scale parameters using an interpolation operation; and generating an encoded output signal comprising information on the encoded representation of the spectral representation and information on the encoded representation of the second set of scale parameters.

25. An apparatus for decoding an encoded audio signal comprising information on an encoded spectral representation and information on an encoded representation of a second set of scale parameters, comprising:

an input interface for receiving the encoded signal and extracting the encoded spectral representation and the encoded representation of the second set of scale parameters;

a spectrum decoder for decoding the encoded spectral representation to acquire a decoded spectral representation;

a scale parameter decoder for decoding the encoded second set of scale parameters to acquire a first set of scale parameters, wherein the number of scale parameters of the second set is smaller than a number of scale parameters of the first set;

a spectral processor for processing the decoded spectral representation using the first set of scale parameters to obtain a scaled spectral representation; and a converter for converting the scaled spectral representation to acquire a decoded audio signal.

26. The apparatus of claim 25, wherein the spectral scale parameter decoder is configured to interpolate the second set of scale parameters in a log-like domain to acquire interpolated log-like domain scale parameters.

27. The apparatus of claim 25, wherein the scale parameter decoder is configured to decode the encoded spectral representation using a vector dequantizer providing, for one or more quantization indices, the second set of decoded scale parameters, and wherein the scale parameter decoder is configured to interpolate the second set of decoded scale parameters to acquire the first set of scale parameters.

28. The apparatus of claim 25, wherein the scale parameter decoder is configured to determine an interpolated scale parameter based on the quantized scale parameter and a difference between the quantized scale parameter and a next quantized scale parameter in an ascending sequence of quantized scale parameters with respect to frequency.

29. The apparatus of claim 28, wherein the scale parameter decoder is configured to determine, from the quantized scale parameter and the difference at least two interpolated scale parameters, wherein for the generation of each of the two interpolated scale parameters a different weighting factor is used.

30. The apparatus of claim 29, wherein the scale parameter decoder is configured to use the weighting factors, wherein the weighting factors increase with increasing frequencies associated with the interpolated scale parameters.

31. The apparatus of claim 25, wherein the scale parameter decoder is configured to perform the interpolation operation in a log-like domain, and to convert interpolated scale parameters into a linear domain to acquire the first set of scale parameters, wherein the log-like domain is a log domain with a base of 10 or with a base of 2.

32. The apparatus of claim 25, wherein the spectral processor is configured to apply a temporal noise shaping (TNS) decoder operation to the decoded spectral representation to acquire a TNS decoded spectral representation, and to weight the TNS decoded spectral representation using the first set of scale parameters.

33. The apparatus of claim 25, wherein the scale parameter decoder is configured to interpolate quantized scale parameters so that interpolated quantized scale parameters comprise values being in a range of ±20% of values acquired using the following equations:

$$scfQint(0) = scfQ(0)$$

$$scfQint(1) = scfQ(0)$$

$$scfQint(4n+2) = scfQ(n) + \frac{1}{8}(scfQ(n+1) - scfQ(n)) \text{ for } n = 0 \ldots 14$$

$$scfQint(4n+3) = scfQ(n) + \frac{3}{8}(scfQ(n+1) - scfQ(n)) \text{ for } n = 0 \ldots 14$$

$$scfQint(4n+4) = scfQ(n) + \frac{5}{8}(scfQ(n+1) - scfQ(n)) \text{ for } n = 0 \ldots 14$$

-continued $$scfQint(4n+5) = scfQ(n) + \frac{7}{8}(scfQ(n+1) - scfQ(n)) \text{ for } n = 0 \ldots 14$$

$$scfQint(62) = scfQ(15) + \frac{1}{8}(scfQ(15) - scfQ(14))$$

$$scfQint(63) = scfQ(15) + \frac{3}{8}(scfQ(15) - scfQ(14))$$

wherein scfQ(n) is the quantized scale parameter for an index n, and wherein scfQint(k) is the interpolated scale parameter for an index k.

34. The apparatus of claim 25, wherein the scale parameter decoder is configured to perform an interpolation to acquire scale parameters within, with respect to frequency, the first set of scale parameters and to perform an extrapolation operation to acquire scale parameters at edges, with respect to frequency, of the first set of scale parameters.

35. The apparatus of claim 34, wherein the scale parameter decoder is configured to determine at least a first scale parameter and a last scale parameter of the first set of scale parameters with respect to ascending frequency bands by an extrapolation operation.

36. The apparatus of claim 25, wherein the scale parameter decoder is configured to perform an interpolation and a subsequent transform from a log-like domain into a linear domain, wherein the log-like domain is a log 2 domain and wherein the linear domain values are calculated using an exponentiation with a base of two.

37. The apparatus of claim 25, wherein the encoded audio signal comprises information on a global gain for the encoded spectral representation, wherein the spectrum decoder is configured to dequantize the encoded spectral representation using the global gain, and wherein the spectral processor is configured to process the dequantized spectral representation or values derived from the dequantized spectral representation by weighting each dequantized spectral value or each value derived from the dequantized spectral representation of a band using the same scale parameter of the first set of scale parameters for the band.

38. The apparatus of claim 25, wherein the converter is configured to convert time-subsequent scaled spectral representations;

to synthesis window converted time-subsequent scaled spectral representations, and to overlap-and-add windowed converted representations to acquire a decoded audio signal.

39. The apparatus of claim 25, wherein the converter comprises an inverse modified discrete cosine transform (MDCT) converter, or wherein the spectral processor is configured to multiply spectral values by corresponding scale parameters of the first set of scale parameters, or wherein the second number is 16 and the first number is 64, or wherein each scale parameter of the first set is associated with a band, wherein bands corresponding to higher frequencies are broader than bands associated with lower frequencies, so that a scale parameter of the first set of scale parameters associated with a high frequency band is used for weighting a higher number of spectral values compared to a scale parameter associated with a lower frequency band, where the scale parameter associated with the lower frequency band is used for weighting a lower number of spectral values in the low frequency band.

40. A method for decoding an encoded audio signal comprising information on an encoded spectral representation and information on an encoded representation of a second set of scale parameters, comprising:

receiving the encoded signal and extracting the encoded spectral representation and the encoded representation of the second set of scale parameters;

decoding the encoded spectral representation to acquire a decoded spectral representation;

decoding the encoded second set of scale parameters to acquire a first set of scale parameters, wherein the number of scale parameters of the second set is smaller than a number of scale parameters of the first set;

processing the decoded spectral representation using the first set of scale parameters to acquire a scaled spectral representation; and converting the scaled spectral representation to acquire a decoded audio signal.

41. A non-transitory digital storage medium comprising a computer program stored thereon to perform the method for encoding an audio signal, comprising:

converting the audio signal into a spectral representation;

calculating a first set of scale parameters from the spectral representation:

downsampling the first set of scale parameters to acquire a second set of scale parameters, wherein a second number of scale parameters in the second set of scale parameters is lower than a first number of scale parameters in the first set of scale parameters;

generating an encoded representation of the second set of scale parameters;

processing the spectral representation using a third set of scale parameters, the third set of scale parameters comprising a third number of scale parameters being greater than the second number of scale parameters, wherein the processing uses the first set of scale parameters or derives the third set of scale parameters from the second set of scale parameters or from the encoded representation of the second set of scale parameters using an interpolation operation; and generating an encoded output signal comprising information on the encoded representation of the spectral representation and information on the encoded representation of the second set of scale parameters, when said computer program is run by a computer.

42. A non-transitory digital storage medium comprising a computer program stored thereon to perform the method for decoding an encoded audio signal comprising information on an encoded spectral representation and information on an encoded representation of a second set of scale parameters, comprising:

receiving the encoded signal and extracting the encoded spectral representation and the encoded representation of the second set of scale parameters;

decoding the encoded spectral representation to acquire a decoded spectral representation;

decoding the encoded second set of scale parameters to acquire a first set of scale parameters, wherein the number of scale parameters of the second set is smaller than a number of scale parameters of the first set;

processing the decoded spectral representation using the first set of scale parameters to acquire a scaled spectral representation; and converting the scaled spectral representation to acquire a decoded audio signal, when said computer program is run by a computer.

* * * * *